US012594478B2

(12) United States Patent
Rothschild

(10) Patent No.: US 12,594,478 B2
(45) Date of Patent: Apr. 7, 2026

(54) PLYOMETRIC EXERCISE DEVICE

(71) Applicant: Sound Shore Innovations L.L.C., Darien, CT (US)

(72) Inventor: Kyle D. Rothschild, Darien, CT (US)

(73) Assignee: Sound Shore Innovations L.L.C., Darien, CT (US)

( * ) Notice: Subject to any disclaimer, the term of this patent is extended or adjusted under 35 U.S.C. 154(b) by 0 days.

(21) Appl. No.: 18/279,197

(22) PCT Filed: Mar. 25, 2022

(86) PCT No.: PCT/US2022/021862

§ 371 (c)(1),
(2) Date: Aug. 28, 2023

(87) PCT Pub. No.: WO2022/204465

PCT Pub. Date: Sep. 29, 2022

(65) Prior Publication Data

US 2024/0165481 A1 May 23, 2024

Related U.S. Application Data

(60) Provisional application No. 63/166,017, filed on Mar. 25, 2021.

(51) Int. Cl.
*A63B 71/00* (2006.01)
*A63B 21/00* (2006.01)
*A63B 21/055* (2006.01)

(52) U.S. Cl.
CPC ..... *A63B 71/0036* (2013.01); *A63B 21/0552* (2013.01); *A63B 21/4035* (2015.10); *A63B 2225/093* (2013.01)

(58) Field of Classification Search
CPC ..... A63B 5/00; A63B 5/16; A63B 21/00047; A63B 21/0442; A63B 21/0552;
(Continued)

(56) References Cited

U.S. PATENT DOCUMENTS 5,921,899 A * 7/1999 Rose ..... A63B 22/18 482/77
9,878,198 B2 * 1/2018 Johnson ..... A63B 23/0458
(Continued)

FOREIGN PATENT DOCUMENTS

CN 112237728 A * 1/2021 ..... A63B 69/004
EP 2891510 B1 * 11/2017 ..... A63K 3/043
(Continued)

OTHER PUBLICATIONS

International Search Report and Written Opinion mailed Sep. 23, 2022 for PCT/US2022/021862 filed Mar. 25, 2022 (12 pages).

*Primary Examiner* — Gary D Urbiel Goldner
(74) *Attorney, Agent, or Firm* — MLO, a professional corp.

(57) ABSTRACT

A plyometric exercise device having an extended exercise position and a collapsed storage position. The plyometric exercise device has a flat top for use as a jump-off platform when raised above a ground surface, and a support frame that can be extended or assembled into the extended exercise position, or collapsed into the collapsed storage position. A base can be used as part of the support frame or as a separate component provided in the extended exercise position as a secure footing of the plyometric exercise device onto the ground surface.

16 Claims, 27 Drawing Sheets

(58) Field of Classification Search
CPC ..... A63B 21/0557; A63B 21/0783; A63B 21/4009; A63B 21/4015; A63B 21/4027; A63B 21/4029; A63B 21/4034; A63B 21/4035; A63B 23/0458; A63B 26/00; A63B 26/003; A63B 71/0036; A63B 2210/00; A63B 2210/50; A63B 2225/093
See application file for complete search history.

(56) References Cited

U.S. PATENT DOCUMENTS

| | | | | |
|---|---|---|---|---|
| 10,744,361 | B2 * | 8/2020 | Duval | A63B 21/4037 |
| 10,926,122 | B2 * | 2/2021 | Hausheer | A63B 5/16 |
| 11,583,723 | B2 * | 2/2023 | Essex | A63B 21/4037 |
| 2004/0082441 | A1 * | 4/2004 | Kastelic | A63B 23/0458 482/52 |
| 2006/0243522 | A1 | 11/2006 | Hart et al. | |
| 2009/0124464 | A1 * | 5/2009 | Kastelic | A63B 23/0458 482/52 |
| 2013/0137558 | A1 * | 5/2013 | Ross | A63B 5/16 482/142 |
| 2015/0111701 | A1 * | 4/2015 | Kempka | A63B 5/16 482/15 |
| 2015/0196799 | A1 | 7/2015 | Chua | |
| 2017/0082342 | A1 * | 3/2017 | Weinberg | B65D 25/2805 |
| 2018/0008857 | A1 * | 1/2018 | Barber | A63B 21/0428 |
| 2018/0229098 | A1 * | 8/2018 | McCorkle | A63B 23/0458 |
| 2018/0280752 | A1 | 10/2018 | Duval | |
| 2019/0168051 | A1 * | 6/2019 | Hausheer | A63B 5/00 |
| 2020/0001127 | A1 * | 1/2020 | Hume | A63B 21/068 |
| 2020/0246657 | A1 * | 8/2020 | Wittenbrink | A63B 21/4033 |
| 2021/0016130 | A1 * | 1/2021 | Cope | A63B 21/4029 |
| 2021/0052936 | A1 * | 2/2021 | Park | A63B 21/0085 |
| 2021/0086021 | A1 * | 3/2021 | Constantz | A63B 21/002 |
| 2022/0203157 | A1 * | 6/2022 | Rogers | A63B 21/4033 |
| 2022/0241662 | A1 * | 8/2022 | Burk | A63B 69/0097 |
| 2025/0256145 | A1 * | 8/2025 | Westmoreland | A63B 21/00047 |

FOREIGN PATENT DOCUMENTS

| | | | | |
|---|---|---|---|---|
| GB | 2524568 | B * | 3/2016 | A63B 71/0054 |
| GB | 2501613 | B * | 8/2016 | A63B 23/0458 |
| GB | 2602616 | A * | 7/2022 | A63B 17/04 |
| KR | 101271329 | B1 * | 6/2013 | A63B 71/0669 |
| KR | 101787561 | B1 * | 10/2017 | B66F 7/065 |

* cited by examiner

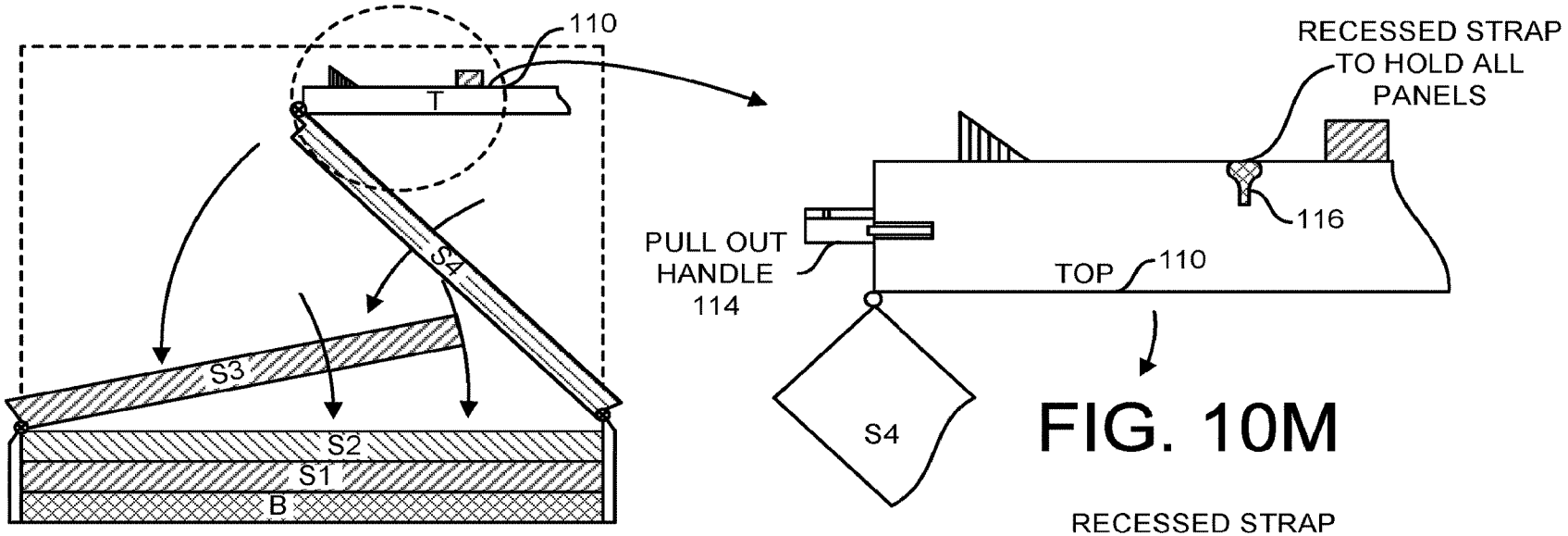
FIG. 10M
FIG. 10L
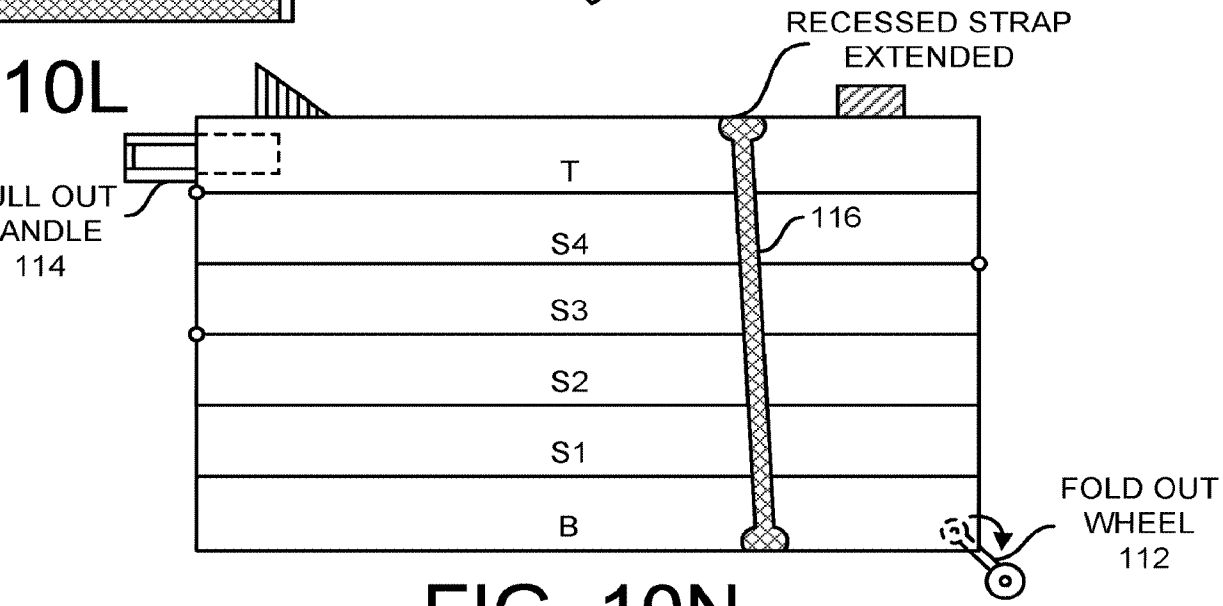
FIG. 10N

PLYOMETRIC EXERCISE DEVICE

CROSS-REFERENCE TO RELATED APPLICATIONS

This application is a national stage application of PCT App. Ser. No. PCT/US2022/021862, filed on Mar. 25, 2022, which claims priority of U.S. Pat. App. Ser. No. 63/166,017, filed on Mar. 25, 2021, the contents of each of which are hereby incorporated by reference.

FIELD

The following description relates to plyometric exercise devices, and in particular to such devices suitable for storage and transportation.

BACKGROUND

Plyometrics, or "jump training," is a form of exercise performed to generate fast, powerful movements, either for improving performance in a particular sport or to improve fitness generally. Plyometrics involve explosive movements such as jumping or sudden bursts of acceleration which cause the muscle to be rapidly loaded and then contracted. The aim of plyometrics is to create the greatest amount of force in the shortest amount of time, resulting in stronger muscles and improved athletic performance. Plyometrics can help in building speed and strength to improve a person's performance of a specific action such as jumping, running or throwing.

A plyometric box, or "plyo" box, is an exercise device that is used to facilitate the performance of certain plyometric exercises. The plyo box provides a raised stable platform for a person to jump onto and off. A typical plyometric exercise involves a person jumping with both feet onto the platform from a standing start on the ground and then jumping off the plyo box to return to the start position. Plyometric exercises may include box jumps, depth jumps, step ups, step ups with barbells, and burpee box jump overs, among others. A box jump, for example, involves a person standing on the floor facing a plyometric box and jumping with both feet onto the top surface of the plyometric box. The box jump typically involves repeatedly jumping onto and off the plyometric box. A depth jump involves jumping or falling off a short plyometric box onto the floor and then quickly jumping onto a taller plyometric box. Under normal exercise conditions, plyo boxes are thus subjected to repeated impact, usually at a great force. As a result, it is desirable that such boxes be both strong and rigid, and not break or bend notably when subjected to repeated powerful impact.

Traditional plyo boxes comprise a wooden or metal frame supporting a rigid platform. Such rigid boxes are generally provided in a range of sizes enabling different jumps and different levels of muscle exercise. Typical plyo boxes may be 30 inches (76.2 cm), 24 inches (60.96 cm), 20 inches (50.8 cm) high. Other height and size options are available. To ensure sturdiness and a mechanical strength, a wooden box may have 1 inch (2.54 cm) thick wood and a compact frame.

Existing plyometric boxes are difficult to store and transport. Further, typical plyometric boxes are large and heavy and awkward to move around. While some plyometric boxes can be nested within one another, they often are too big to fit into an automobile, thus limiting the ability to move plyometric boxes from gym to gym or from a gym to a park, or to another location where someone desires to use the device. For example, a personal trainer is unlikely to transport typical plyometric boxes to a park for an outdoor training session or into the home of an individual. Therefore, due to the difficulty in transporting typical plyometric boxes, plyometric jumping exercises are frequently limited to the gym, where the boxes may still take too much space when not used.

SUMMARY

In one aspect, a plyometric exercise device is provided, comprising a flat top; a base; and a folding support frame; wherein the plyometric exercise device has an exercise position in which the folding support frame is attached to and raises the flat top above the base to a predetermined distance corresponding to an exercise height of the plyometric exercise device; and a storage position in which the folding support frame is folded and is at least partially enclosed within a recess of the flat top, reducing the distance between the top and the base to a storage height of the plyometric exercise device; wherein the folding support frame comprises (a) one or more folding side panels, each comprising two leaves connected by a hinge enabling rotation such that in the storage position the leaves are folded on each other, and in the exercise position the leaves are rotated about the hinge to provide maximum side panel extension corresponding to the exercise height of the plyometric exercise device; and (b) one or more support studs, which in the exercise position of the plyometric device extend from the flat top to the base of the plyometric exercise device and support the folding side panels in extended position, and in the storage position of the plyometric device fit at least partially within a storage space in one or both of the flat top and the base.

In a specific example, the plyometric exercise device has a flat top with rectangular shape and rounded corners. In another example, the plyometric exercise device further comprises one or more rigid one-piece side panels that in the exercise position extend between the flat top and the base, and provide support for the flat top, the one or more rigid side panels fitting within a recess of the flat top in the storage position. The plyometric exercise device in this aspect of the disclosure may have a flat top with a layer of material providing increased friction. Additionally, the base may further comprise a plurality of adjustable feet that may be used when the plyometric exercise device is placed on ground surface to adjust the plyometric exercise device in position above the ground surface. Furthermore, the flat top of the device may further comprise recesses corresponding to the positions of the adjustable feet on the base, to enable stacking of multiple plyometric exercise devices on top of each other in storage or exercise position.

In one aspect, the storage height of the plyometric exercise device is at least three times shorter than the exercise height of the plyometric exercise device, wherein the exercise height of the plyometric exercise device is, for example, one of 12 inches, 20 inches, 24 inches or 30 inches.

In another aspect, the plyometric exercise device may comprise additional support studs to support different surfaces of the device in the exercise position. At least some support studs can be of I-Beam type. The device may further comprise at least two holes of approximately 1" diameter in the flat top and a notch on an underside surface of the flat top for attaching resistance bands.

In an example of a plyometric exercise device the base comprises one or more indents for housing wheels to transport the plyometric exercise device, and it may further comprise one or more folding wheels that in the exercise position of the device fit within the one or more indents, and in the storage position are folded out to enable rolling the device on the one or more wheels. In another example, the plyometric exercise device may further comprise a handle attached to the top or to the base for carrying the plyometric device.

In a separate example, the plyometric device further comprises a sled, removably attached to the base of the plyometric device, and a handle for pushing or pulling the plyometric device on the sled; the device may further comprise a storage space for placing additional weights.

In another aspect, two or more of the plyometric exercise devices having folding frames can be stacked on top of each other, each of the two or more plyometric devices being either in a storage position or in an exercise position.

In another aspect, a plyometric exercise device is provided, comprising: a flat top having a top surface and an underside comprising linear indentations; a first pair of substantially similar rectangular slabs having first length, width and thickness; and a second pair of substantially similar rectangular slabs having the same width and thickness as the first pair of slabs, and a second length shorter than the first length, and each slab in the first and second pair of slabs has along the length of the slab two parallel cutout slits extending perpendicularly to about half the width of the slab; wherein the plyometric exercise device has a storage position in which the flat top, and the first and second pairs of slabs are placed parallel to each other; and one or more exercise positions in which the first and second pairs of rectangular slabs are arranged perpendicular to each other along their respective lengths, and are assembled such that cutout slits in each two perpendicular slabs form an interlocking arrangement, and the first and second pair of slabs are locked into each other in an number sign arrangement having the same width as the first and second pairs of slabs; and the linear indentations in the underside of the flat top have substantially the same width as the thickness of the first and second pair of slabs, said linear indentations being adapted to receive edges of the slabs in the number sign arrangement of the first and second pair of slabs to form a plyometric exercise device.

In a specific example, the plyometric exercise device may be arranged in three different orientations in which the flat top defines a landing platform of three different heights. In another example, the plyometric exercise device further comprises one or more sockets placed at the cross point where the supporting slabs interlock in exercise position, and reinforcing bolts that slide into the one or more sockets for supporting the frame of the plyometric exercise device.

In yet another aspect, a plyometric exercise device is provided, comprising: a flat top; and a support frame comprising four or more equal length legs; wherein the plyometric exercise device has an exercise position in which the four or more legs of the support frame are removably attached at an angle between 80° to 90° to the flat top to raise it to a predetermined distance corresponding to an exercise height of the plyometric exercise device determined by the length of the four or more legs and the angle at which they are attached to the flat top; and a storage position in which the four or more legs of the support frame are detached from the flat top and are held fixed with respect to each other and to the flat top for storage and transportation. The four or more legs of the support frame may have a generally conical shape with a large base to provide a grip onto a ground surface in the exercise position. Further, the support frame may comprise at least two sets of four or more legs, wherein the length of at least two sets of legs is different.

In yet another aspect, a self-contained plyometric exercise device is provided, comprising: a flat top; a base; and a folding support frame connected to the flat top and the base; wherein the self-contained plyometric exercise device has an exercise position in which the folding support frame supports the flat top above the base to a predetermined distance corresponding to an exercise height of the self-contained plyometric exercise device; and a storage position in which the folding support frame is folded, reducing the distance between the flat top and the base to a storage height of the self-contained plyometric exercise device; wherein the folding support frame comprises (a) a first and second rigid side panels rotatably attached using hinges to the base at opposite ends thereof, such that in the exercise position the first and second side panels are positioned upright to support the flat top at the exercise height of the self-contained plyometric exercise device, and in the storage position the first side panel rests on a top surface of the base, and the second side panel rests on a top surface of the first side panel, and (b) a connecting side panel connecting the flat top and the base, the connecting side panel rotatably attached at a first end to the base using a hinge, such that in the exercise position the connecting side panel is positioned upright to support the flat top at the exercise height of the self-contained plyometric exercise device, and in the storage position the connecting solid side panel is positioned above the second side panel; and wherein the connecting side panel is rotatably attached at a second end using a hinge to an end of the flat top, enabling a rotation of the flat top around the hinge, such that a top surface of the flat top in the exercise position becomes a bottom surface of the flat top in the storage position and the bottom surface of the flat top in the storage position rests on a top surface of the connecting side panel, and further wherein the base, the first and second side panels, the connecting side panel, and the flat top are attached to each other to form a self-contained plyometric exercise device in the exercise position and in the storage position.

In a specific example, the self-contained plyometric exercise device further comprises a fourth solid side panel rotatably attached to the base using a hinge opposite the connecting side panel, such that in the exercise position the fourth side panel is positioned upright to support the flat top at the exercise height of the self-contained plyometric exercise device, and in the storage position the fourth side panel rests on a top surface of the second side panel.

In another example of the self-contained plyometric exercise device in the exercise position the first, second and fourth side panels are locked in position using latches located in the flat top, and in the storage position the latches are released and the first, second, the connecting, and the fourth side panels are stacked on top of each other by rotating about the hinges connecting the first, second, the connecting and the fourth side panels to the base.

In another example, the self-contained plyometric exercise device further comprises a handle attached to the top or to the base for carrying the plyometric device in the storage position. In another example of the self-contained plyometric exercise device further comprises a fold out wheel attached to the base for carrying the plyometric device in the storage position. In another example, the self-contained plyometric exercise device in the storage position is held together using a strap that in the exercise position is placed in a recess of the flat top.

The current subject matter provides many advantages. For example, the current subject matter provides for improved plyometric exercise devices that lack deficiencies associated with conventional devices, and in particular that are suitable for easy storage and transportation.

BRIEF DESCRIPTION OF THE DRAWINGS

The foregoing summary, as well as the following detailed description, will be better understood when read in conjunction with the appended drawings. For the purpose of illustration, certain examples of the present description are shown in the drawings. It should be understood, however, that the current subject matter is not limited to the precise arrangements and instrumentalities shown. The accompanying drawings, which are incorporated in and constitute a part of this specification, illustrate an implementation of systems, apparatuses, and methods consistent with the present description and, together with the description, serve to explain advantages and principles consistent with the current subject matter.

FIG. 1N shows a side view of illustrating modified I-bean studs and rounded corners in an example; FIG. 1O illustrates a side view of an I-beam stud and three views along the long axis of the stud, including a stylized view and two more popular types cross-sections. FIG. 1P shows a side view with retaining clips for holding support studs.

FIGS. 10A-10N illustrate an alternate embodiment of an integral collapsible plyo box in which solid side panels attached to the top and the base collapse in the storage position onto each other in a given order, and the support frame is at least partially enclosed between the flat top and the base. FIG. 10A is a block diagram introducing the notations used; FIGS. 10G and 10H are side view illustrations with certain elements shown in greater detail, while

FIGS. 10L, 10M and 10N illustrate the use of various attachments that provide additional flexibility especially in storage position. In particular, FIG. 10L illustrates stacking of side panels and the flat top in the storage position; FIG. 10M illustrates the use of a pull-out handle for carrying the device, and a recess for storing a strap; FIG. 10N illustrates the plyo box in storage position, including a pull out handle (shown in the flat top), fold out wheel (shown in the base), and strap which when extended holds the plyo box together in storage position.

Figure 1A:
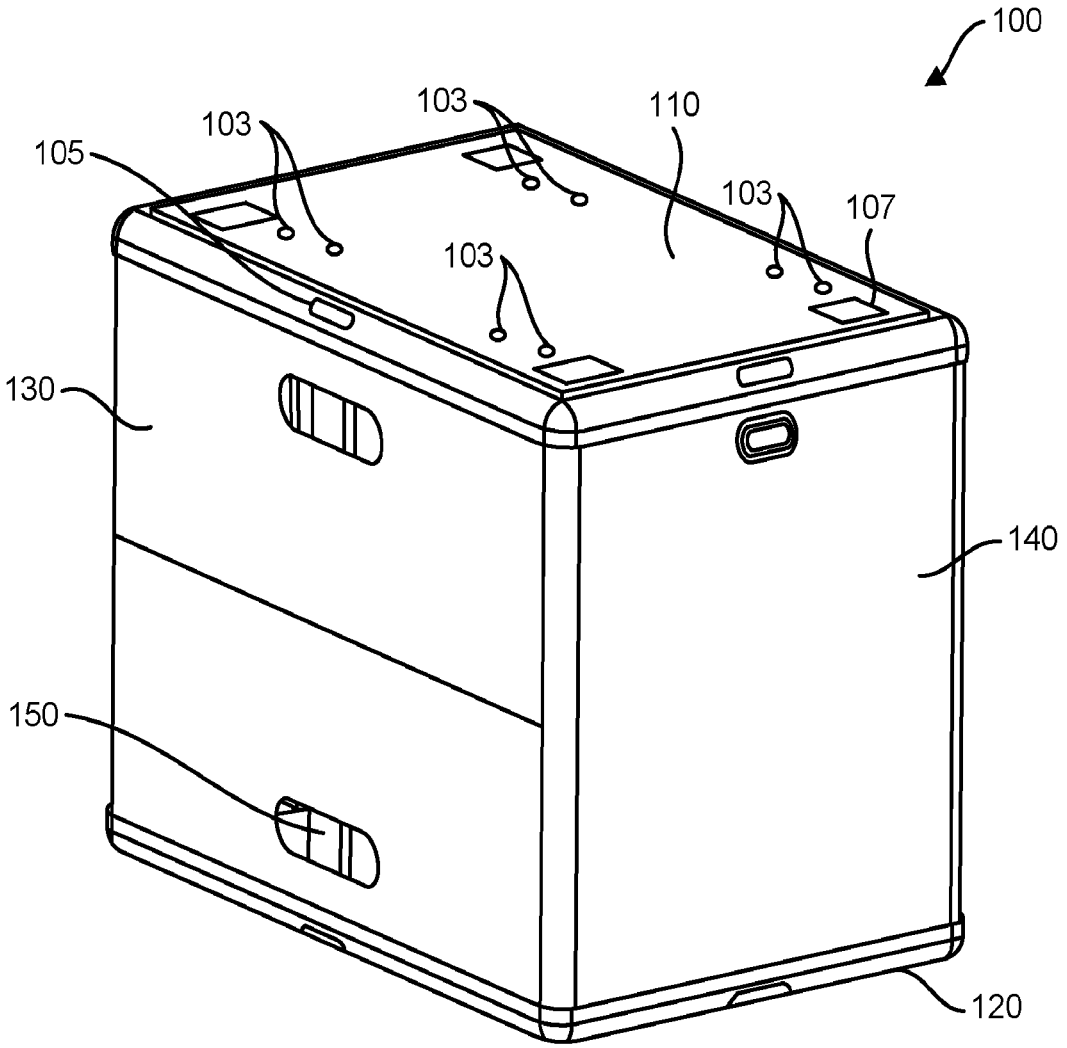
FIGS. 1A, 1B and 1C are different perspective views of an example of a plyometric exercise device using folding support in an exercise position.

The relative size and depiction of individual elements, features and structures is not to scale and may be exaggerated for clarity, illustration, and convenience.

DETAILED DESCRIPTION

The following detailed description is provided to assist the reader in gaining an understanding of the devices and systems described herein. Accordingly, various changes, modifications, and equivalents of the systems, apparatuses and/or methods described herein will be suggested and thus apparent to those of ordinary skill in the art. Also, descriptions of well-known functions and constructions may be omitted for clarity and conciseness.

In addition, it is to be understood that the phraseology and terminology employed herein are for the purpose of description and should not be regarded as limiting. For example, the use of a singular term, such as, "a" is not intended as limiting of the number of items. Also the use of relational terms, such as but not limited to, "left," "right," "upper," "lower," "down," "up," "side," are used in the description for clarity and are not intended to limit the scope of the current subject matter or the appended claims. These terms may be used solely to distinguish one entity or element from another entity or element without necessarily requiring or implying any physical or logical relationship or order between such entities or elements. The term "flat" in the disclosure is intended to mean generally smooth and even, without marked lumps or indentations. The term "folding", in the context of a piece of equipment, means able to be bent or rearranged into a flatter or more compact shape, in order to make it easier to store or carry. "Collapsible" objects in this disclosure are objects that are able to be folded into a smaller space. "Rigid" are materials or items that are physically inflexible or stiff, and thus resist bending. "Strong" are materials or items able to resist heavy impacts, and are able to absorb and distribute large amounts of energy without breaking. A material's flexibility does not reflect negatively upon its strength, as even the bendiest materials which resist breakage are technically very strong. "Resilient" in this disclosure are devices capable of withstanding shock without permanent deformation or breakage. A "position" is the particular way in which something is placed or arranged.

As used herein, the term "about" means plus or minus 10% of a given value unless specifically indicated otherwise. As used herein, the term "shaped" means that an item has the overall appearance of a given shape even if there are minor variations from the pure form of said given shape. Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value. A "layer" is a sheet, quantity or thickness of material forming a solid body or surface. Other terms are discussed in some detail in the body of the text as necessary.

It should be understood that any one of the features discussed below can be used separately or in combination with other features. Other systems, methods, features, and advantages of the current subject matter will be or become apparent to one with skill in the art upon examination of the detailed description. It is intended that such additional systems, methods, features, and advantages be included within this description, be within the scope of the current subject matter, and be protected by the accompanying claims.

A. Introduction

A plyo box set made in accordance with the principles set forth herein serves as one of the essential pieces of plyometric exercise equipment that can be used at a gym, at home, or in outdoor settings. In the following disclosure, the terms "plyometric device" and "plyo box" are used interchangeably, even though some plyometric devices discussed herein may not technically be "boxes". A full plyo box set can come with several platforms of different heights and widths, such as five or six different boxes that enable different exercises. Some common sizes include (all dimensions in inches, where 1 inch=25.4 mm) 24×30×20; 3×30×20; 6×30×20; 12×30×20; 18×30×20. Other examples include 12" plyobox (top 14"×14"-base 16"×16"); 18" plyobox (top 16"×16"-base 20"×20"); 24" plyobox (top 18"×18"-base 22"×22"); 30" plyobox (top 20"×20"-base 25"×25"). The above examples reveal that certain plyo boxes can have all three dimensions (height, width and depth) different. In some cases, the difference in dimensions can be utilized to create two or three different-height examples dependent on how the box is positioned on the ground. Alternatively, some dimensions can be equal (for example, width and depth). It will be appreciated that the above sizes are exemplary only, and can be supplemented or replaced, as necessary, with other dimensions being envisioned in a desired plyo box set.

In use, each plyo box is expected to have certain basic properties. For example, plyo boxes should be resilient, that is, able to withstand repeated powerful impact without breaking or notable bending or deformation when subject to normal use. Plyo boxes also should have enough friction at the top platform, and the base of the device to minimize the likelihood that the person using them slips, thus minimizing injuries. To this end, it is also desirable that a plyo box or stacked boxes (as needed), should sit in a level position, and they (as a stack) also need to have a sturdy overall structure that can be subjected without damage to repeated powerful impact. Avoiding sharp edges or corners is also desirable to avoid injuries, and thus can be applied to all examples discussed herein. Other properties of the plyo boxes will be discussed in more detail in the following examples.

Plyometric box sets may come in basic and advanced options. The basic set is suitable for people who are just getting used to plyometric workout equipment, while the advanced options come with additional boxes that add extra challenge to a workout routine, and/or additional features, such as holes adapted for use with resistance bands, or internal storage space for added weights.

In the context of this disclosure, an important novel feature of the plyometric exercise devices is that one (or two) dimensions of fully assembled boxes in exercise position are collapsible for reduced and more efficient storage and transportation. As will be discussed in the following sections, this feature can be achieved by using several different options or combinations thereof, including for example and without limitation: (a) folding support frames that extend to a full size in exercise position and collapse to a smaller dimension in a storage position; (b) slabs that can be stacked next to or on top of each other in a storage position and assembled into a plyo box structure in an exercise position; (c) examples in which a raised top platform is supported by a set of folding legs with or without additional support studs; and (d) self-contained solid side panel collapsible plyo boxes. Various combinations of the above collapsible options are possible, and will be apparent to a person of ordinary skill in the art after reading this disclosure. While individual plyo boxes are collapsible, it is further envisioned that a set of collapsible plyo boxes can be made stackable for storage into minimized space.

Different examples of the plyometric exercise devices discussed below include plyo boxes comprised, at least in part, of material(s) that provide high strength to weight ratio such as, but not limited to, steel, wood, composite plastic, high density foam, rubber, or other similar materials. A single plyo box can be made of one material, or combination of different materials suitable for the respective purpose. As discussed next, in different examples the exercise equipment of the present disclosure includes a strong and rigid top (a platform raised above the ground), a support frame for raising the top above ground, and a base sitting on a ground surface and providing support for the entire device. In some examples, two or more of these components can merge into a single one performing multiple functions. Importantly, in a specific aspect of the current subject matter, it is expected that an individual plyo box can be used in more than one exercise configuration. That is, different surfaces of the device can be used as the top, base and side(s) to give the user more flexibility in selecting different exercise heights.

For purposes of the current subject matter, the focus of the disclosure is on the support frame which can take different forms. Thus, in some examples the support frame can be collapsing, that is, folded when the device is in a storage position and extended in exercise position to provide rigid support. Alternatively, support frames can include different slabs of material that are stacked on each other for minimized storage space in storage position, and assembled into a framework supporting the top at different heights in an exercise position. In yet another alternative, the support frame can include different variations of support legs with or without additional supporting framework. In a yet different alternative, the support frame can be put together from solid side panels that in storage position are stacked on top of each other in a particular order.

For ease of reference, in the following discussion similar components are labeled similarly. Thus, and with reference to the attached figures, a plyo box regardless of the particular configuration is designated 100 and includes a top or platform 110; a support frame 130 configured to allow conversion of the box to an operating height in an exercise position, and collapsing of the box to a compact form suitable for storage and transportation in a storage position; and a bottom or base portion 120 resting on the ground that carries the top 110 and the support frame 130. Thus, support frame 130 is configured to raise the top 110 from the bottom 120 to a desired height or heights in an exercise position, and collapse the overall device to a smaller size in a storage position. In examples where the folding support frame 130 comprises legs, the base portion 120 can merge or be made integral with the support frame 130. As mentioned, it is envisioned that in specific examples different sides of the device may serve as a "top", a "base", or a "support frame", and hence these designations are not attached to a specific surface of the device, but rather to the spatial orientation of the respective surface in an exercise position.

Specifically, in some examples the plyo box of the current subject matter may have a cuboid body with a height, width and depth that have different lengths such that the box may be arranged in three different orientations in which the uppermost face defines a landing platform of three different heights. In other examples, different parts of the support frame and the base can be used in different configurations with reference to the ground level to provide variety of exercise heights for the plyo box 100. The overall compact structure in storage position may be provided with wheels for easy transportation. Optional attachable wheels and/or a handle can be used to provide a compact, transportable platform design. In different examples, the top surface of top or platform 110 can be provided with recesses or indentations that match corresponding extensions of the base portion 120 to provide stackability of the plyo box set.

B. Folding Support Examples

FIGS. 1A-1R, 2 and 3 illustrate a plyometric device 100 from different angles and in different spatial orientations in examples using folding support frame. Plyo box 100 in this example has two main positions: a first (or exercise) position in which the device is expanded to its maximum dimensions, and a second (or storage) position in which the support frame 130 is collapsed. To avoid any misunderstanding, it should be noted that the collapsible plyo box of the current subject matter can be used for training in both expanded and collapsed position. Hence the designation "storage" position is used to refer to the collapsed position of the device for notational convenience, and not as a limitation that requires a collapsed box to be "stored".

Figure 1B:
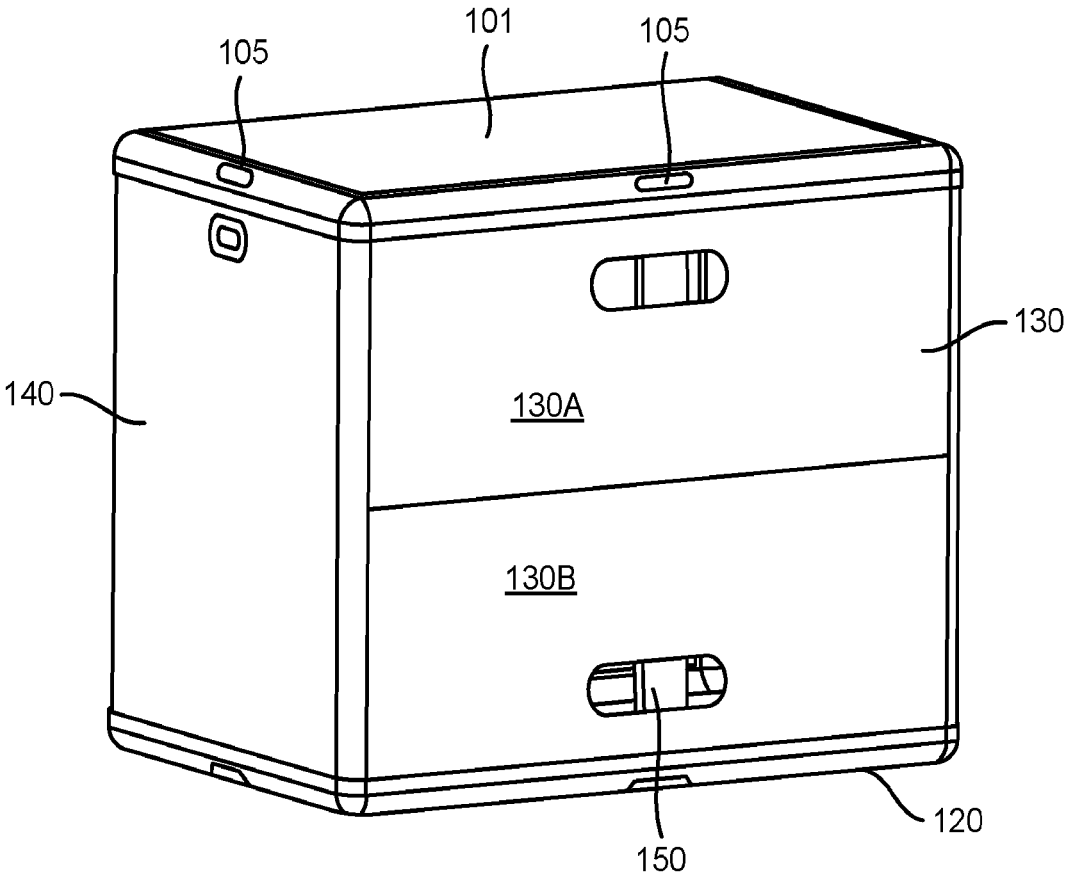
Figure 1C:
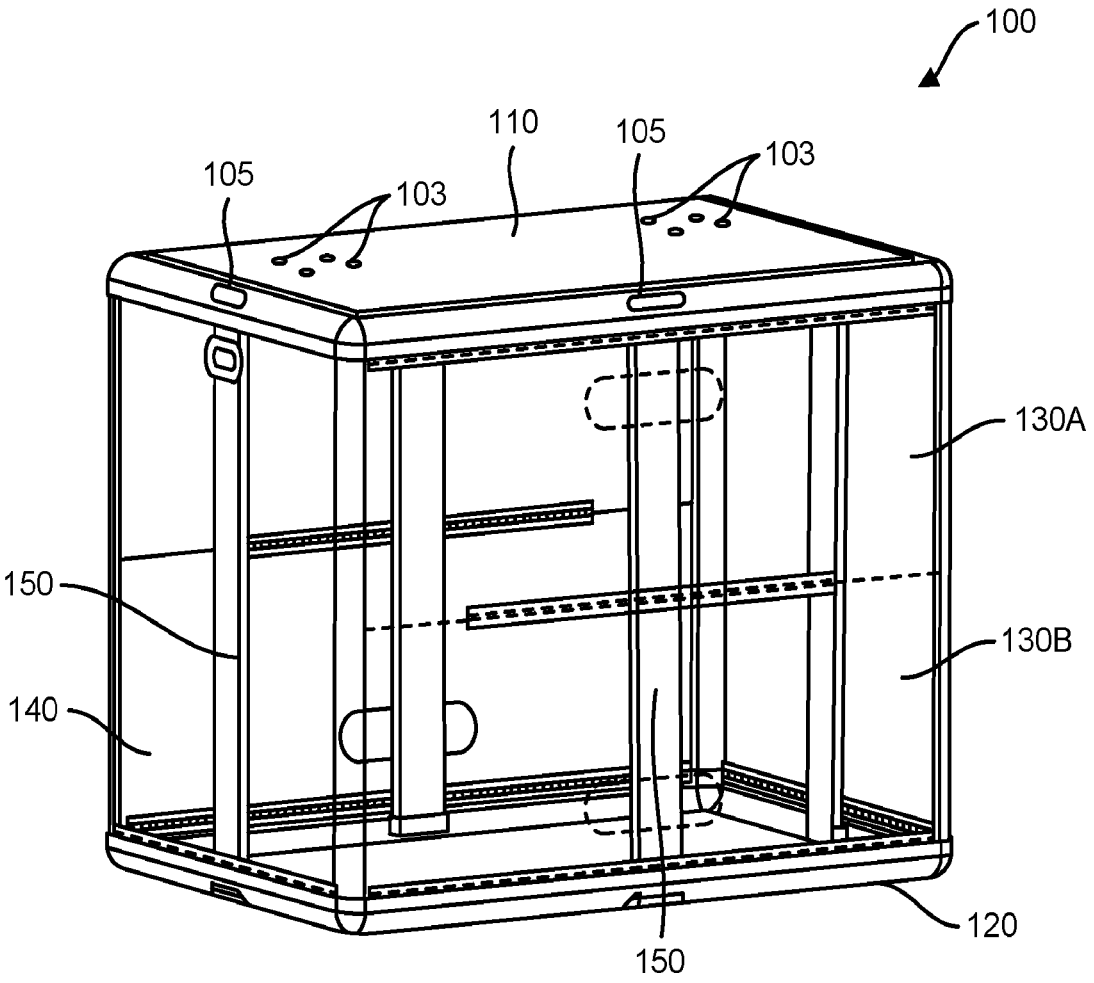

In particular, FIGS. 1A, 1B and 1C are perspective views from above of a plyometric equipment 100 in an exercise position. As illustrated, in the particular example plyometric device 100 comprises a flat top designated 110, a bottom designated 120, a folding support frame generally designated 130 and, optionally, one or more side panels designated 140. Overall dimensions of the device (expressed in inches) are 20×24×30 in a specific illustrative example. Thus, the height of the device in an exercise position could be one of 30 inches (76.2 cm), 24 inches (60.96 cm), or 20 inches (50.8 cm).

1. The Top

A typical top 110 in accordance with the example illustrated in FIGS. 1A, 1B, 1C, has a square or generally rectangular shape. In other examples the shape of the top can be circular, oval, trapezoidal, or other shapes. In general, the requirement is that the top 110 provide adequate space for the two feet of a user to land on the platform. The actual dimensions of the top can thus be determined by the overall size of the desired plyo box for a normally expected user. Typical width and depth dimensions for the top used in rectangular plyo boxes are 30"×24". The thickness of top 110 is determined by the material used to make the device, and in the specific prototype example illustrated best in FIGS. 1F and 1G, which is made of fiber-reinforced plastic, is approximately 1.5"-2" inches (3.81 cm-5.08 cm) thick. The top has a top surface 101 and an underside (illustrated in FIG. 1D). The actual thickness of top 110 may be determined by structural and material choice considerations to ensure that the top surface is strong and rigid enough to take repeated impacts of at least 500-750 pounds (or more) per box without breakage or deformation. To avoid sharp edges that may cause injuries, the corners of the top surface can be rounded, as illustrated in FIG. 1A to 1R, FIG. 2 and FIG. 3. In a specific embodiment illustrated in FIGS. 1F and 1G the top 110 and the rest of the box 100 is made out of a composite plastic similar to the wood plastic composite available for chairs decking, etc., and can be reinforced.

The top surface 101 can desirably have a rubber or other suitable coating to reduce slipping. The thickness of the coating can be between about ⅛ to ¼ of an inch (0.3175 cm to 0.635 cm), and a high durometer (about 100) to ensure it does not wear off after repeated use. In a specific example, the top surface 101 of the top 110 can be provided with a shock absorbing layer (not shown) located at and bonded to the outer surface of the top. The shock absorbing layer can be formed of a foam material having high density. An outer cushioning layer may be used to surround and encapsulate the shock absorbing layer to provide the device with a soft feel to further limit abrasion and/or impact injuries. Depending on the make, the coating can be made integral with, or of the same material as the top 110.

Figure 8:
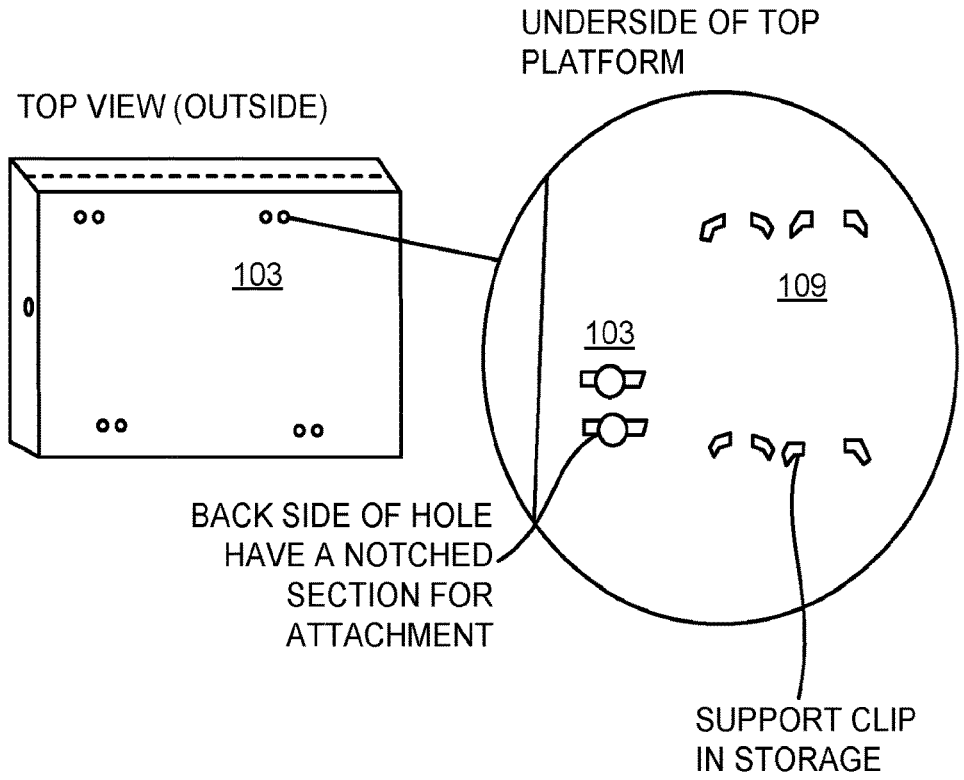
FIG. 8 illustrates an example of a collapsible plyo box with additional detail, including two or more holes for adding resistance bands and other equipment used in conjunction with the plyo box.

In a specific example, the top 110 also has two or more holes 103 for adding resistance bands and other equipment used in conjunction with the plyo box. With further reference to FIG. 1F and FIG. 8, the holes may be around 1" (2.54 cm) in diameter and may have a notched underside so that a resistance band with a small peg can be inserted in a vertical position then turned horizontal and sit in place when a pulling force is applied. In addition, the top surface may have recesses or indentations 107 of approximately 0.2" (5 mm) or 0.25" (6.35 mm) depth which serve to facilitate stacking of multiple plyo boxes in storage position. In particular, and with further reference to FIGS. 1F and 1G corresponding feet or extensions at the bottom surface of the bottom can be dimensioned to fit into recesses 107 to keep a stack of plyo boxes firmly together for storage or use in a stacked set for height variation and flexibility. It is well known that users can and often do buy multiple size boxes to be able to have varying heights during a training period. For example, it is very common for athletes to stack these on top of another to test their maximum vertical jump ability.

Figure 1D:
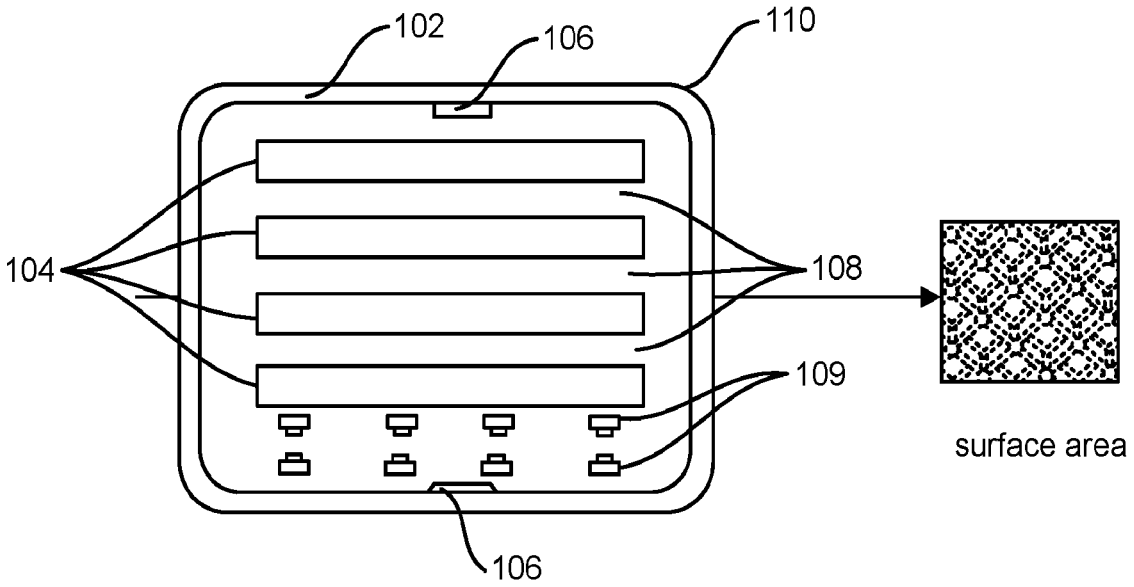
FIG. 1D illustrates the underside of the top surface of the plyometric exercise device in FIGS. 1A, 1B, and 1C, with support studs embedded in or secured to the underside for ease of storage and transportation, and an example of a surface area.

The underside of top 110 is illustrated in one example in FIG. 1D. In a specific example, it comprises a protruding rim 102 along the periphery that, along with a matching rim of the base 120, provides an enclosure in the storage position of the device, as illustrated best in FIG. 3. Accordingly, as shown in the example illustrated in FIG. 3, in a closed position the top and the bottom portion of the device can lock in, creating a flat collapsed box that contains the support frame. By means of a non-limiting example, the height of the closed box shown in FIG. 3 could be reduced to about 4" to 8" (15.24 to 20.32 cm), although other dimensions are possible depending on the specific choice of a support frame. This translates to a compact ratio of about 3 to 6 times in the example of a 20"×24"×30" box, and is indicative of the potential space savings realized using the devices of this disclosure for a typical gym or home training facility.

With further reference to FIG. 1D, the flat surface of the underside of top 110 may have separate regions. First, it may have reinforcing ribs 108 providing structural stability of the top. Generally, ribs 108 are elongated raised pieces of stronger or thicker material across the surface of the underside, or through the structure, serving to support and/or strengthen it. Alternatively, to reduce the weight of the device without affecting its structural integrity, the underside of the top 110 can be made to include a plurality of holes, as illustrated in the cutout in FIG. 1D, or in honeycomb, or other suitable arrangements providing structural integrity.

Second, the underside has storage compartments 104 for storing the supporting studs 150 described below, or other items depending on the specific embodiment(s) of the support frame. Additional storage compartments within the underside of the top may be provided to store other components of the device, as needed. In one example illustrated in FIG. 1D storage compartments 104 are indentations in the underside of the top 110 providing snug fit for the supporting studs or other items that are typically part of the folding support frame 130. In another example also illustrated in FIG. 1H, in storage position the studs can be held in place using support clips 109. As a practical matter, the length of the storage compartments is determined by the maximum height of the desired box: the clips allow the supports to snap into the underside of the top platform. Therefore the size would be at least 24" wide and as long as the maximum allowable height of the box. It will be appreciated that the clips can be used to hold in place other items.

In a specific example, the underside of the top 110 may also have slits in the base of the rim 102, long and narrow openings for inserting the edges of the side panels 140. Folding of the side panels into storage position in one example is illustrated in FIG. 1K. In this particular example, the side panels are attached to the top 110 or to the bottom 120 of the box using 90° hinges. With reference to FIG. 1D, the top can also have holes 105 for inserting support studs 150, as discussed below. In yet another example, top 110 may have arrangements (not shown) for screwing or otherwise removably fastening and holding in place support legs, material slabs or the like which belong to other parts of the plyo box construction.

The discussion of the top 110 in this example is generally applicable to all embodiments of the device discussed herein, and need not be repeated.

2. The Base

Figure 1E:
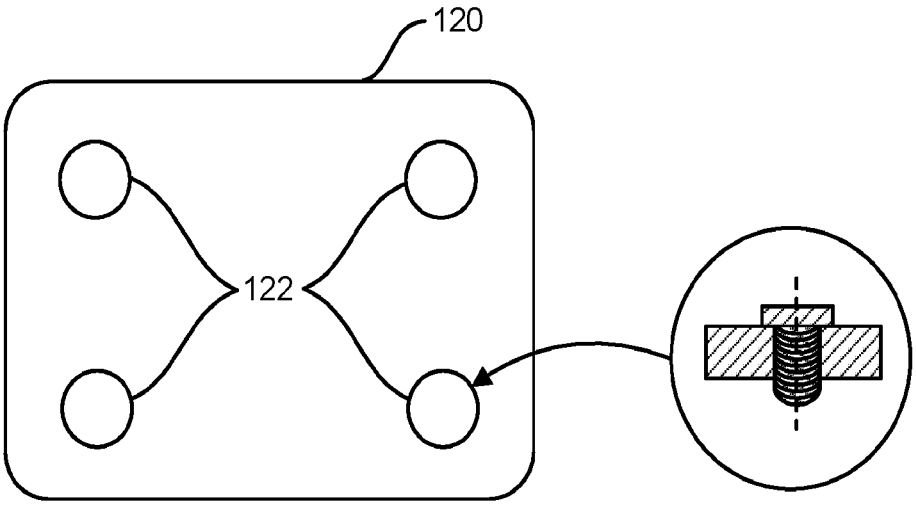
FIG. 1E illustrates an example of the base of the plyometric exercise device in FIGS. 1A, 1B, and 1C, which includes adjustable feet for adjusting the overall height of the device in an exercise or storage position.
Figure 1F:
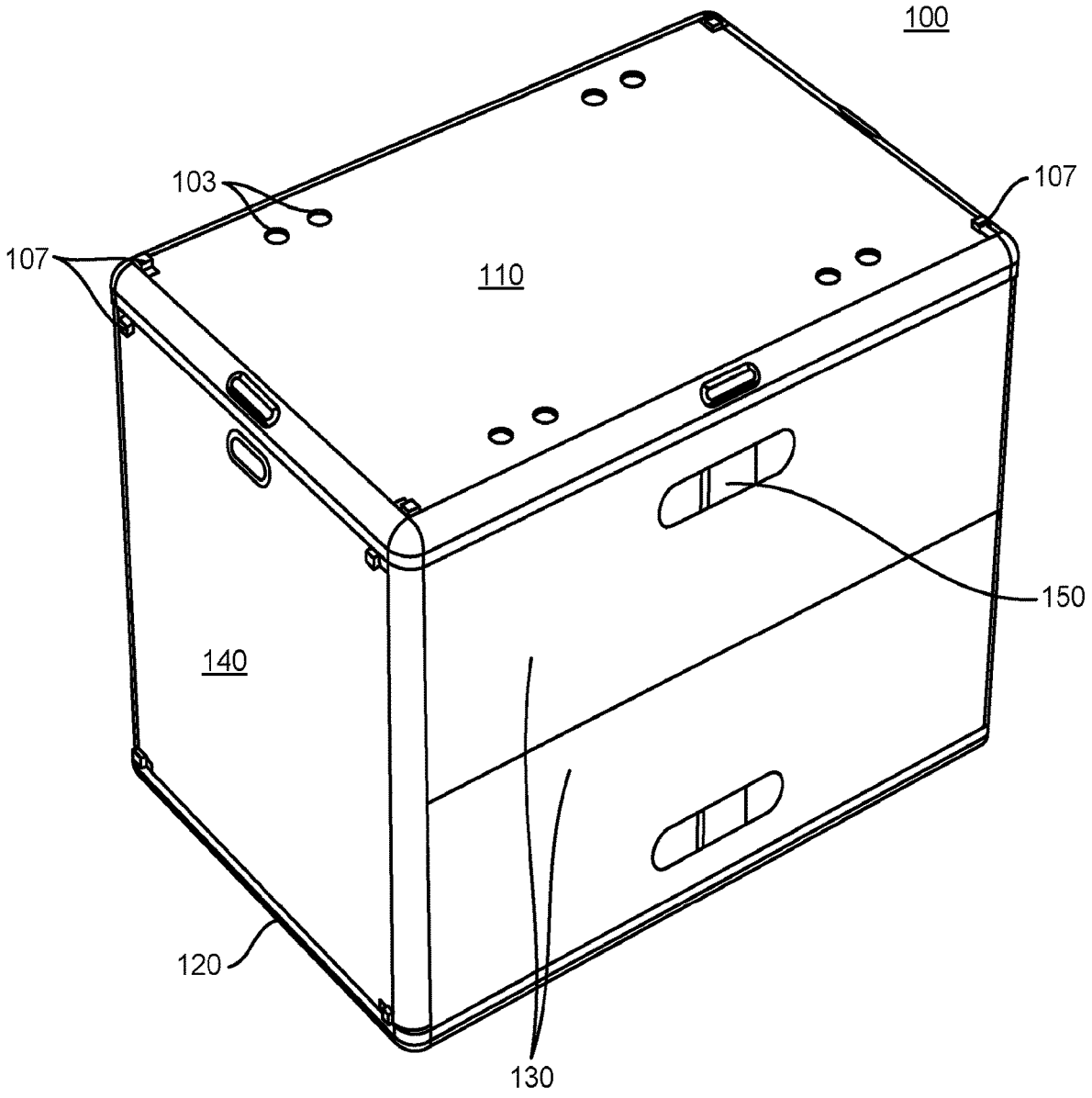
FIG. 1F illustrates a rendition of an assembled plyo box in an exercise position from a top perspective.
Figure 1G:
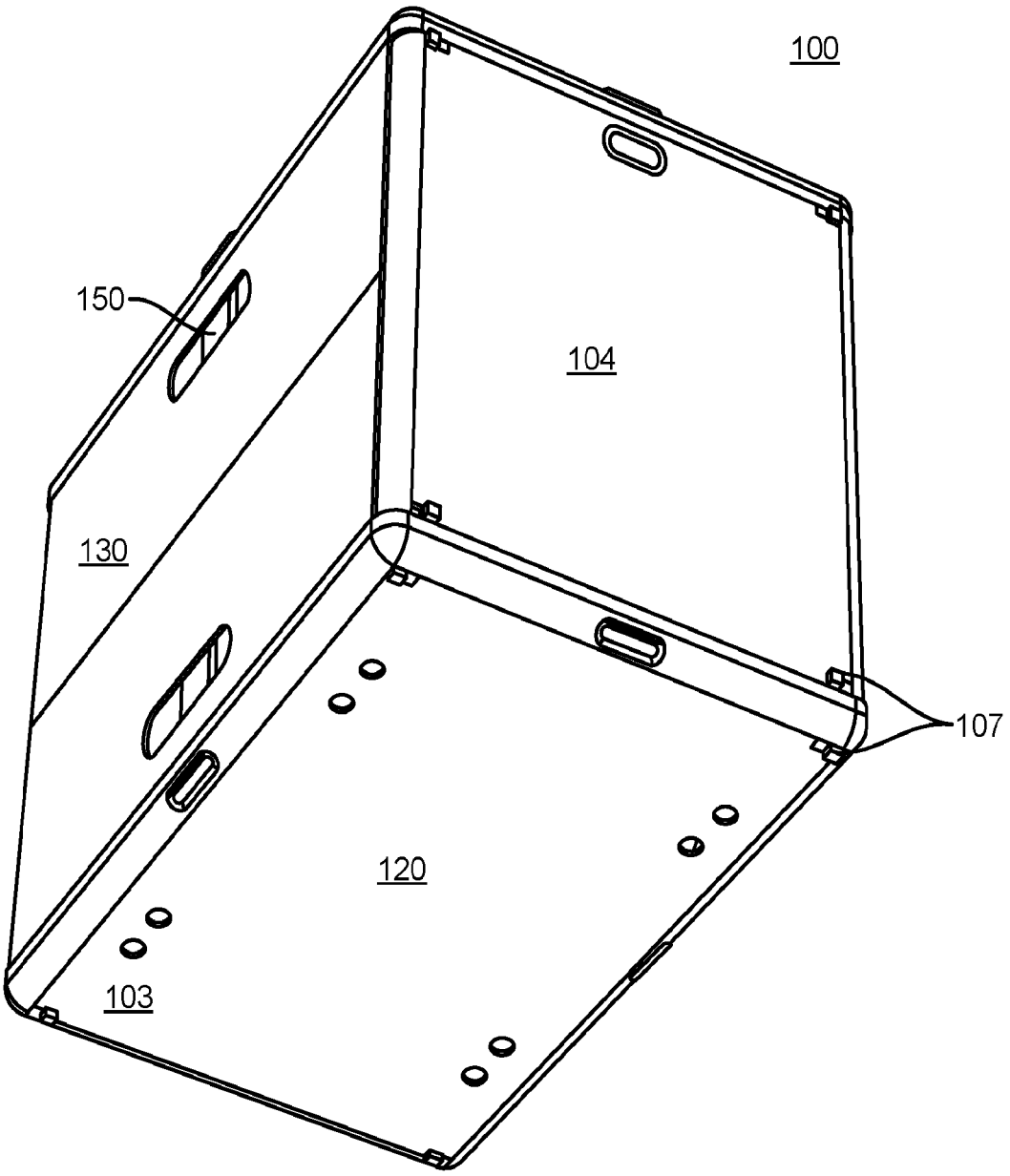
FIG. 1G illustrates a rendition of an assembled plyo box in an exercise position from the bottom perspective.
Figure 1H:
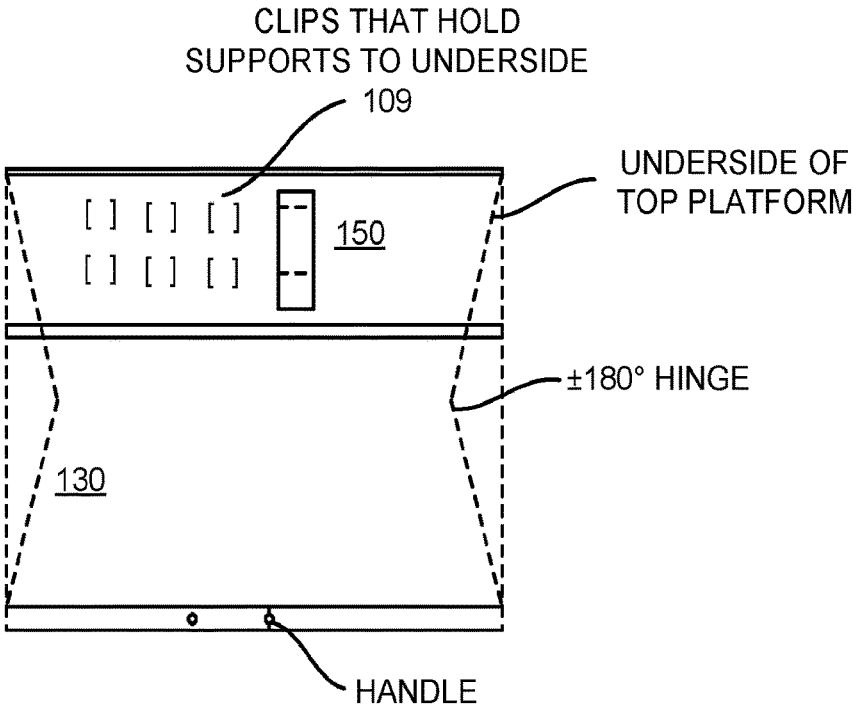
FIGS. 1H and 1K illustrate in diagrammatic form a plyo box in a partially extended position with focus on collapsible elements.
Figure 1K:
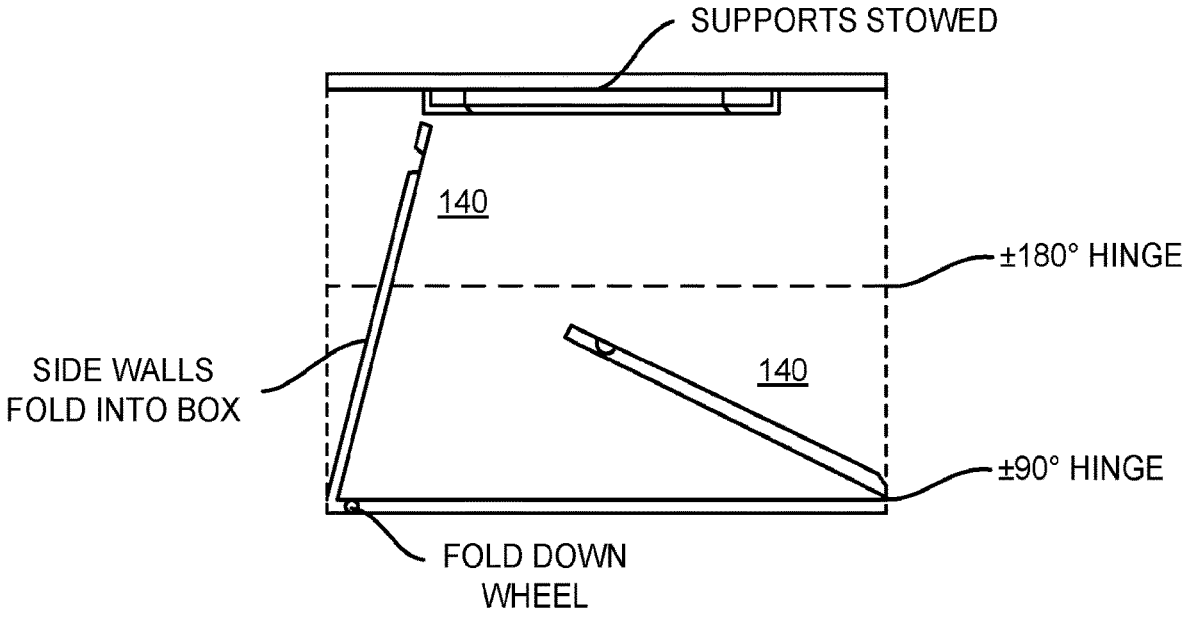

The base 120 of the plyo box 100 is illustrated in exemplary form in FIGS. 1E, 1H and 1K. The main function of the base 120 in the exercise position of the device is to provide a solid hold of the device onto the surface on which the plyo box is placed. In a specific example illustrated in FIG. 1E the base 120 is structurally similar to the top and has a bottom surface (facing the ground) and an inside surface (facing the top of the box). In a specific example, the base 120 may also include multiple adjustable feet 122 that may be used to adjust the overall height of the exercise device 100 and/or to fine tune the height of different portions of the device 100 to enhance stability depending on the flatness of the floor surface. The adjustable feet 122 may also include features for rigidly mounting the exercise plyo box 100 to floors (not shown). Although the example in FIG. 1E has four feet, a different number may be used in alternate embodiments.

Additionally, adjustable feet 122 can be positioned in a manner that corresponds to the recesses or indentations 107 of the top for device stacking in both the storage and the exercise positions. The point is to enable stacking multiple plyo boxes on top of each other, without wasting any extra space between individual boxes, while at the same time ensuring that the boxes are attached to each other in a manner that keeps them together and avoids slipping of one box relative to the other. This feature is illustrated in the examples shown in FIGS. 1A, 1F and 1G and is useful in the storage position to minimize overall space taken by the boxes, as well as in the case when several stacked boxes are used for testing vertical jump ability. It will be appreciated that in a testing context some boxes can be expanded while others can be collapsed. For example, Box 1: 20"×24"×30" may stack on Box 2: 24"×16"×20". In another example, Box 1: 10"×12"×15" can stack with Box 2: 20"×24"×30". Various other examples will be apparent to a person of skill in the art.

Figure 1L:
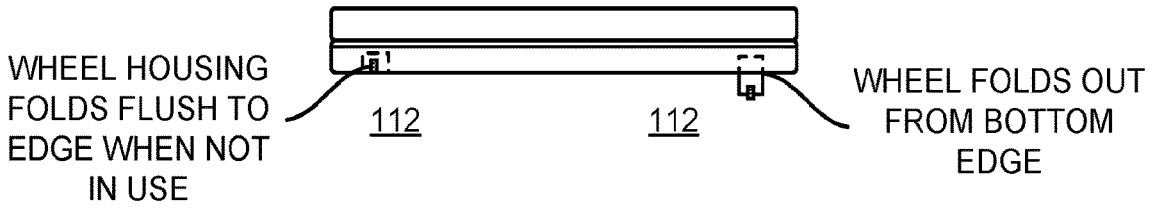
FIG. 1L illustrates in diagrammatic form a plyo box in a closed position including optional wheels.
Figure 1M:
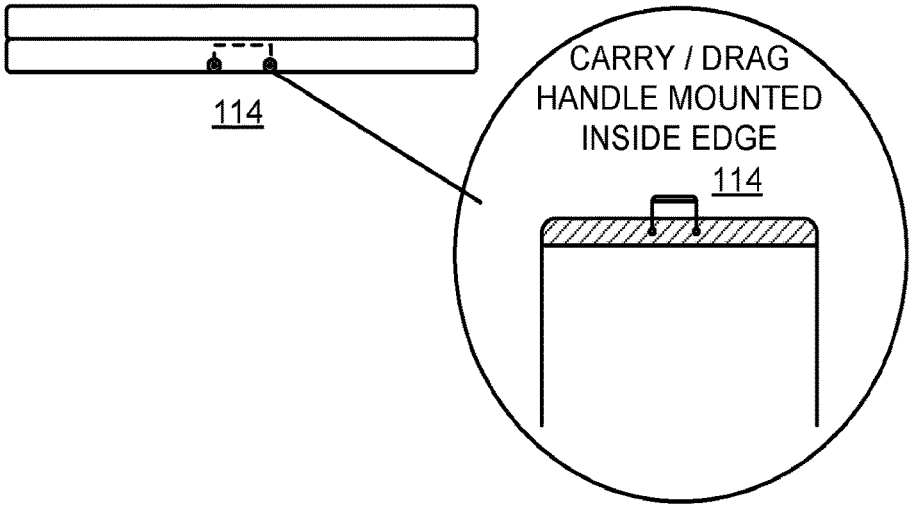
FIG. 1M illustrates in diagrammatic form a plyo box in a closed position including an optional handle.

Optionally, the base can be provided with wheels and/or a handle for ease of moving the box around. One example of such features is illustrated in FIGS. 1L and 1M. As shown in FIG. 1L, in one implementation a set of one or two folding wheels 112 can be provided that in storage position are placed in an indented housing and appear flush with the bottom surface. In a transportation position the wheels are rotated out 90° so as to stand out from the bottom edge and enable rolling of the device in a manner similar to the ubiquitous rolling suitcases. FIG. 1M also illustrates the use of an optional handle 114—here attached to the base of the device—for ease of transportation. In alternative examples the handle 114 can be attached to the top.

The base can be made relatively thin compared to the top to reduce the overall weight of the device. The base could also be made of different materials that make the overall exercise device lighter. In a specific example the base is made of composite plastic, which material appears to provide a good combination of durability, strength, and can be made relatively light weight. In alternate embodiments, the base 120 could have recesses (not illustrated) similar to those in the top 110 for storing parts of the support frame in the storage position of the device. In a specific example illustrated in FIG. 3, the base can be made such as to form together with the top a matching enclosure for the support frame. In different examples it can have a fastener, or some type of locking mechanism keeping all components of device together in a manner similar to a briefcase. Such embodiments can be used with or without the optional features of wheels and handle illustrated in FIGS. 1L and 1M. As with the top 110 above, this section applies to all embodiment that have separate base elements.

It will be appreciated that a base 120 can be used with different alternate examples including the number sign and the support legs examples discussed below. Aside from providing overall stability, the combination of a top and base components creating an enclosure to fit other components of the device has the benefit of holding all components of the device in one place for storage and transportation.

3. The Support Frame

The support frame 130 of the device is the main component that makes the plyometric device of this example portable in the storage position while at the same time providing the support necessary for the use of the device in the exercise position. In accordance with the principles of the current subject matter, different embodiments may be used to this end. One such specific embodiment of a support frame is illustrated in FIGS. 1H, 1K, 1N, 1O, 1R and FIG. 2 in a side view, while in a partially extended position.

Figure 2:
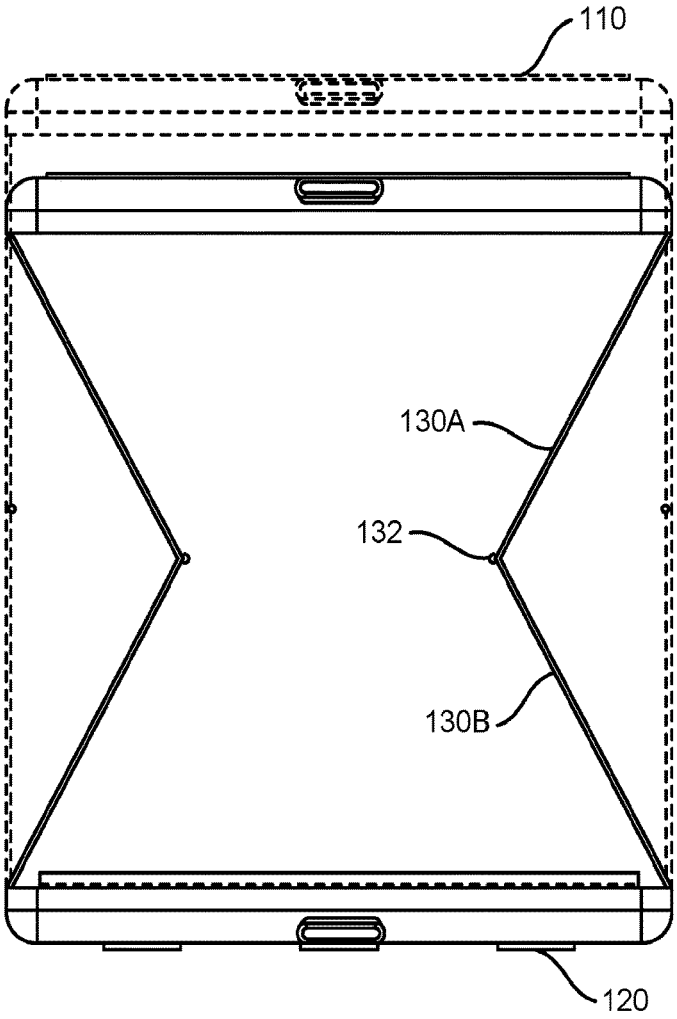
FIG. 2 illustrates a side view of a plyometric exercise device as shown in FIGS. 1A to 1R, in which the folding support frame is partially extended.

In the particular embodiment illustrated in FIG. 2, the support frame 130 comprises one or more folding side panels that provide support for raising the top 110 above the base 120 to the nominal height of the box in its exercise position. Wwo folding support panels 130 can be positioned on opposite sides of the top/base rectangle. Each folding side panel comprises two solid leaves 130A and 130B connected by a hinge 132 enabling 180° rotation. The hinge 132 is restricted to a maximum 180° rotation in which the two leaves of the panel are flush and form a parallel side surface. In the storage position of the device, the leaves are folded on each other, while in the exercise position the leaves are 180° rotated about the hinge to provide maximum extension of the side panel, which extension corresponds to and determines the height of the plyometric exercise device.

The leaves of the folding side panes can be made of composite or fiber reinforced plastic, which, as discussed, offers a good combination of durability, strength and light weight. The thickness of the side panels in specific examples can be about 0.75" to 2". In a specific example, the leaves can be of equal dimensions, so that the hinge is positioned in the middle of the side panel. Other examples are possible, providing different folding. In the particular example illustrated, folding support frame 130 may be rotatably attached to the top 110 and the base 140 via hinges or similar attachments. In this example, the top, the base and the support frame are attached to each other and form a unit. Alternatively, the folding support frame 130 may only be attached to the top 110, or as another example be detached from both the top 110 and the base 120. It will be appreciated that the manner in which the support frame 130 attaches to the top in the base also determines the manner in which it can be folded in the storage and transportation position of the device. The top of this plyometric box has a female channel on the underside that fits into the support frame. This fit is friction secured and could snap into and out of place. Another example of the folding side panels is illustrated in FIG. 1H.

As best illustrated in FIGS. 1A, 1B, 1C, 1F, 1G, and 1N, in the exercise position of the device one or more studs 150 can be used on each side panel to provide additional support and mechanical sturdiness of the device. In the exercise position, that is when the folding leaves 130A and 130B of the support frame are fully extended, one or more studs 150 can be inserted though openings 105 of the top down to a corresponding indent in the base that locks the studs into a fixed position when the device is used. When inserted, studs 150 prevent leaves 130A and 130B of the folding support frame from rotating around the hinge, and thus keep them in fully extended position corresponding to the full height of the plyo box. Studs 150 are made of metal or another material having comparable high strength. Individual support studs 150 in an exemplary embodiment are dimensioned as slabs, but may vary dependent on the position in the side panel. While the support studs shown in the above figures are generally positioned vertically, that is, extending from the top to the base, in other embodiments support studs can be positioned horizontally, which enables the plyo box device to be used with little modification in two or three separate height configurations.

In storage position, the studs 150 may be stored in corresponding recesses in the underside of the flat top as described above and illustrated in FIG. 1D. Alternatively, as shown in FIGS. 1H, 1K, 1P, or FIG. 8, the support studs can be secured for storage and transportation to the top or to the base of the device using support clips.

Figure 1N:
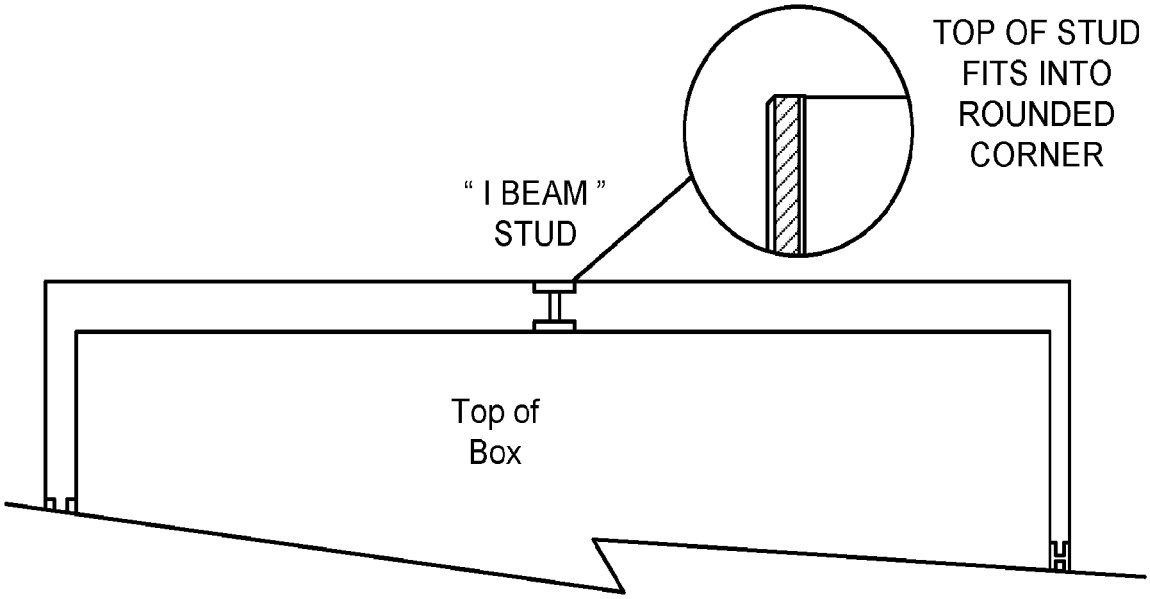
FIGS. 1N, 1O and 1P illustrate an alternative embodiment of the supporting studs, in which an I-beam (also known as H-beam) support studs are used.
Figure 1O:
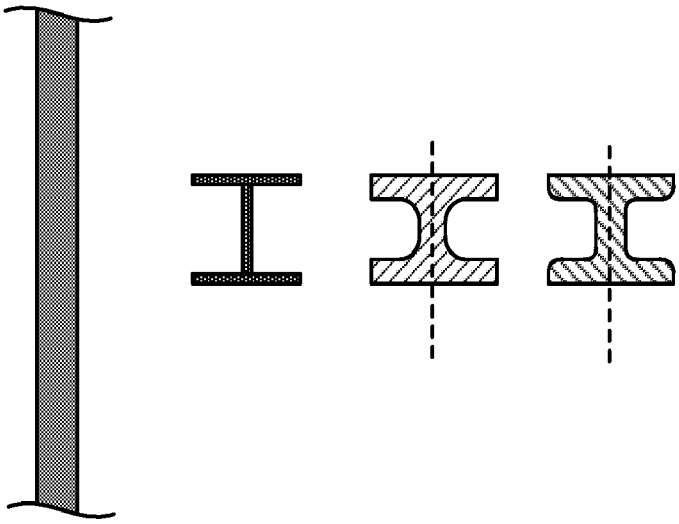
Figure 1P:
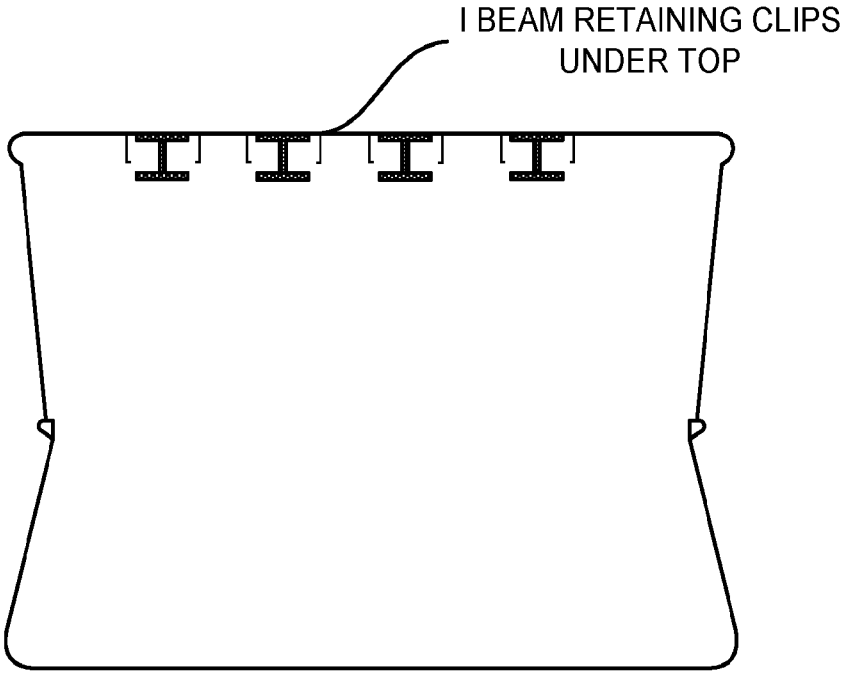

FIGS. 1N, 1O and 1P illustrate an alternative embodiment of the supporting studs, in which an I-beam (also known as H-beam) support studs are used. FIG. 1N shows a side view of illustrating modified I-bean studs and rounded corners in an example; FIG. 1O illustrates a side view of an I-beam stud and three views along the long axis of the stud, including a stylized view and two more popular types cross-sections. FIG. 1P shows a side view with retaining clips for holding support studs.

Figure 1Q:
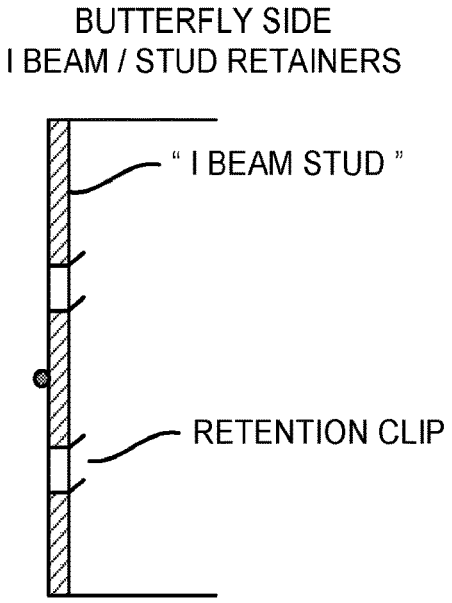
FIG. 1Q illustrates a side view of the butterfly side, including stud retainers.

It will be appreciated that these views are for illustration only and do not reflect the actual dimensions of the studs, which are determined based on the particular application. Still with reference to FIG. 1O, the horizontal elements of the I-beam are referred to as flanges, while the vertical element is known as the "web". The web of an I-beam resists shear forces, while the flanges resist most of the bending moment experienced by the beam. As well-known, a beam under bending forces expected in the use of a plyo box, experiences high stresses along the portions of the beam that are farthest from the neutral axis (the middle of the web). Thus, to prevent failure, most of the material in the beam must be located in these regions. By contrast, comparatively little material is needed in the area close to the neutral axis. This observation is the basis for the form of the I-beam cross-section: the neutral axis runs along the center of the web which can be relatively thin and most of the material can be concentrated in the flanges. As a result, there are certain advantages associated with the use of I-beam studs in the context of plyo box implementations. Most obvious is that because material can be removed, the support studs, which are typically made of metal, can be made relatively light, while still providing the requisite resistance to bending moments experienced in use. Additionally, as illustrated in FIG. 1P, the shape of the cross-section of an I-beam naturally permits for an easy storage under the top using corresponding retaining clips. It will be appreciated that for safety reasons when assembled the tip of an I-beam stud can be rounded off, as shown in FIG. 1N. The I-beam embodiment is further illustrated in FIG. 1Q, illustrating a side view of the butterfly side, including stud retainers.

Figure 1R:
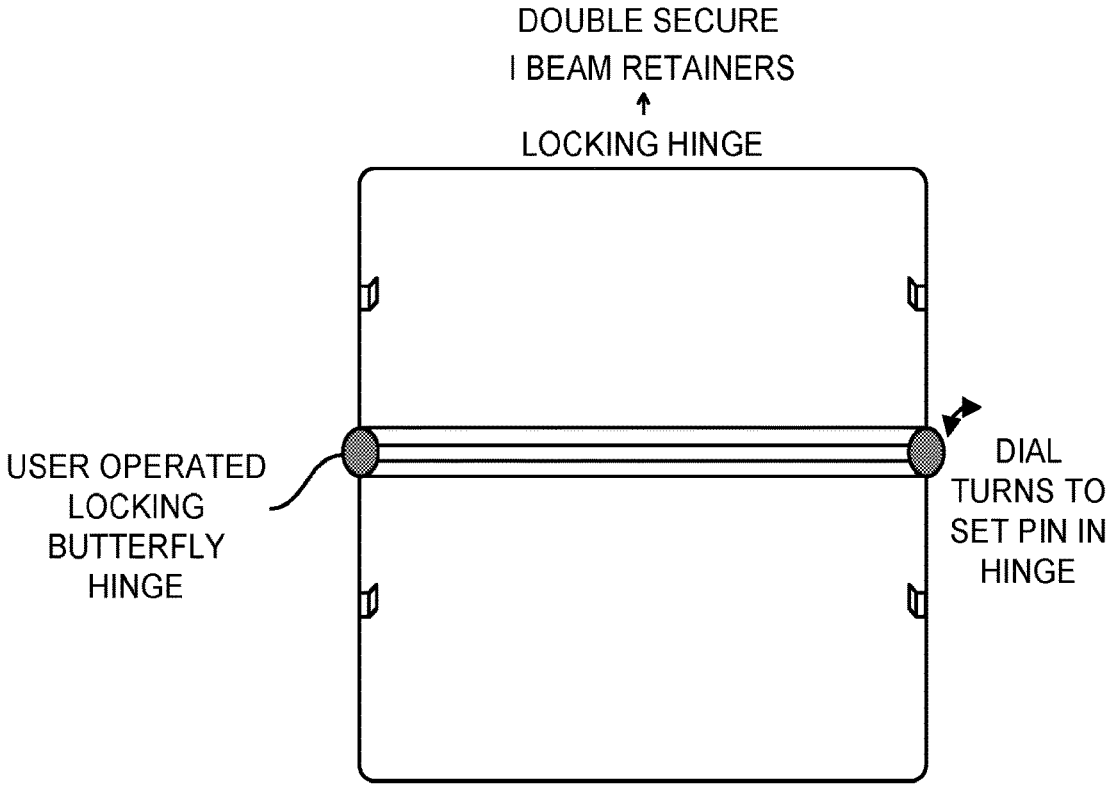
FIG. 1R illustrates an example of a double-secured butterfly hinge.

Yet another example of the plyo box of this disclosure is shown in FIG. 1R, which is a double-secure folding side panel embodiment. In this example, as an alternative, or in addition to the use of support studs, the structural integrity of the folding side panels in the exercise position is secured by the use of locking butterfly hinge mechanism. As shown in this figure, the relative position of the folding side panels can be changed by turning the dial of the hinge to a desired position that secures the desired height of the box. In a fully extended, i.e. 180° position, support studs can be used to provide additional structural integrity.

4. Solid Side Panels

In the example shown in FIGS. 1A, 1B and 1C, in addition to the folding side panels 130, the plyo box may also have a set of two additional side panels 140 each being a single solid piece. These side panels function the same as the folding counterparts 130; they could be made of the same materials and are dimensioned to cover some or all of the remaining (two) sides of the box in an exercise position. As noted, side panels 140 can be removed and in storage position can be inserted into corresponding slots in the top 110 or the base 120. One example is illustrated in FIG. 1K, where the solid side panels are attached to a top or a bottom using 90° hinge. These side panels fold into the box before the longer sides hinge in. The longer sides have a hinge that only allows for 180° of movement and these more narrow side panels only allow for 90° rotation.

Figure 10A:
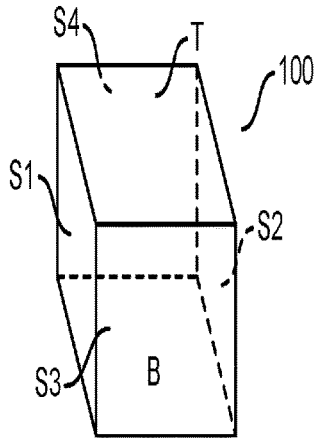

In an alternate example, all side panels of a plyo box can be made solid (not folding). In this example, two opposite side panels can be attached to the top 110, while the remaining side panels can be attached to the base 120 using 90° hinges as shown in FIG. 1K. Each side panel may further be reinforced with one or more support studs 150 that can be positioned vertically as illustrated, horizontally, or in a combination of a vertical and horizontal support. A detailed description of such an alternative using all solid side panels is provided in Section E below, and is illustrated in FIGS. 10A-10N.

In a specific example, the base 120 of the plyo box 100 may have a larger area than the area of the top 110, the base 120 providing overall stability for the plyo box 100 in the exercise position. The exercise platform 100 may further include each of front and back walls 130A, 130B and lateral sidewalls 120. Because of the difference in area of the top 110 and base 140, the front and back walls 130A, 130B and or the side panels 120 may be angled. The angle of the sidewalls may vary, however, in at least certain implementations can be from 90° (vertical) to and including about 95-100° to facilitate rowing exercises. It will be appreciated that in examples of angled side panels appropriate adjustments would have to be done to the overall construction. Thus, for example, the studs could be stored in the base portion of the device instead of the top.

5. Assembly and Use

Figure 3:
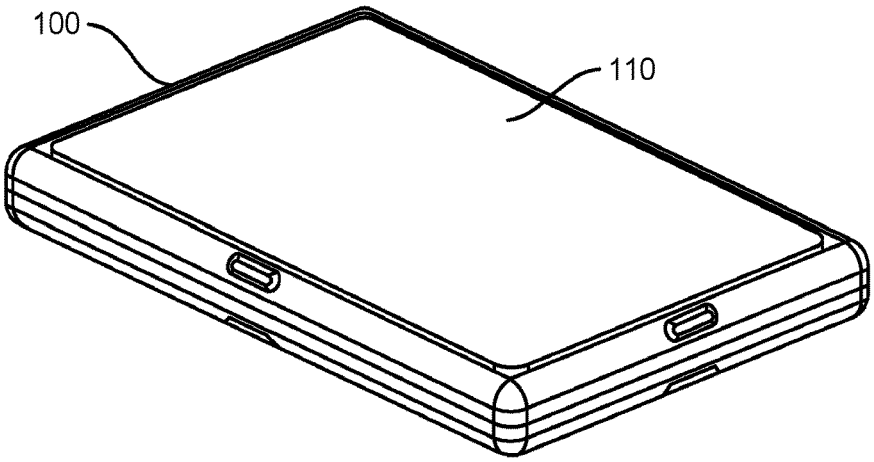
FIG. 3 illustrates a plyometric exercise device as shown in FIGS. 1A to 1R, in which the folding support frame is closed and the device is in a storage position.

As shown in FIG. 3, in storage position the plyometric exercise box 100 in accordance with the current subject matter, is folded into a minimum height configuration and has the appearance of a suitcase. In this storage configuration multiple boxes 100 could be stacked up to reduce storage space requirements, or for easy transportation.

To assemble the box 100 in exercise position one can first unlock the connection between the top 110 in bottom 120 (not shown) and remove studs 150 from their storage position in the underside of the top 110 (or base 120). Depending on the configuration, one can then also remove the optional side panels 140 and the folding side panels 130. In particular, in examples where the folding side panels 130 are attached to the top 110 and to the base 120, by lifting the top 110 away from the base 120 one can cause the folding leaves of support frame 103A and 103B to rotate around hinge 132 until they reach a fully extended position. In that position, one would insert studs 150 to lock the entire box in an upright or exercise position. Side panels 140 are also attached at this time along with corresponding studs 150 as necessary. The fully assembled box 100 can then be used as a regular plyo box either alone, or in combination with other such boxes that permit stackable arrangement.

C. Number Sign Embodiment(s)

FIGS. 4A-4I illustrate a plyometric exercise device in an example using stackable support slabs of same or different length enabling assembly in multiple height configurations.

In the specific illustrated example, plyometric box 100 comprises five separate planar surfaces or slabs labeled 10, 20, 30, 40 and 50. Slab 10 is used in all exemplary embodiments as the top 110 of the plyo box. As shown in the drawing, slab 10 provides in the exercise position a flat top surface, a platform that can be made of wood or other suitably strong material capable of withstanding repeated large force impact. While in this figure the shape of the top is shown rectangular, it will be appreciated that it can be shaped as a circle, an oval, trapezoidal, or any other shape suitable for a plyo box. As in other embodiments, slab 10 has a top surface which is substantially flat and may in different examples be covered with a layer of rubber or other material that increases friction for better engagement when the user jumps onto or off the box.

Figure 4A:
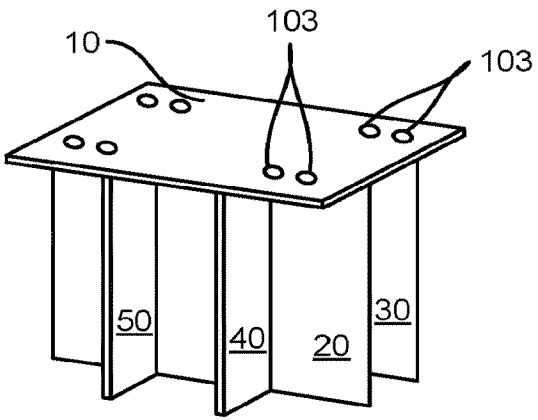
FIGS. 4A, 4B, 4C, 4D, 4E and 4F illustrate a plyometric exercise device in an example using stackable support slabs of different length enabling assembly in multiple height configurations.
Figure 4B:
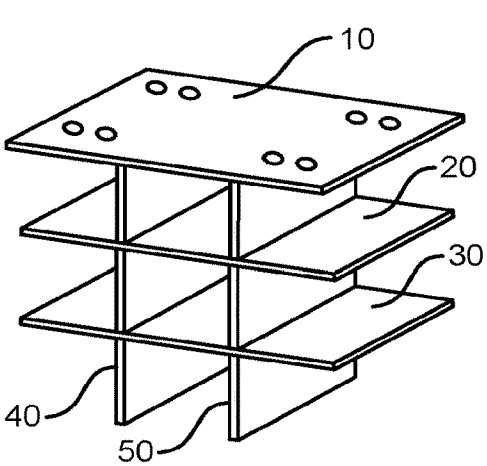
Figure 4C:
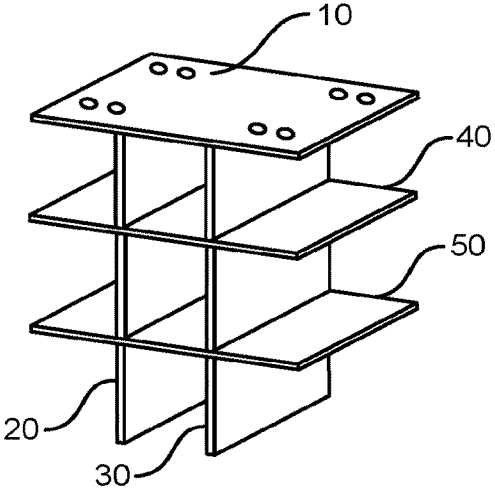
Figure 4D:
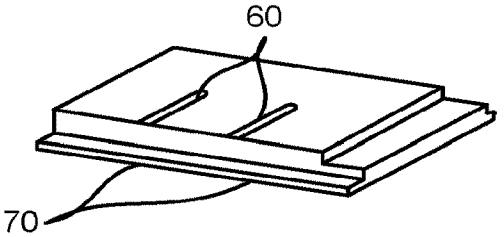
Figure 4D:
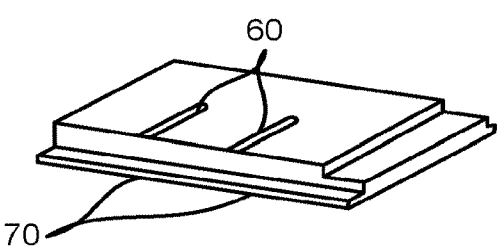
Figure 4D:
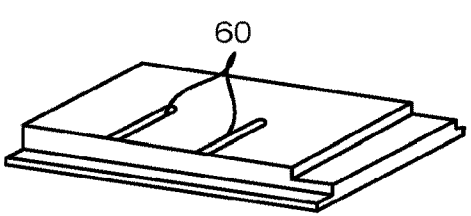
Figure 4E:
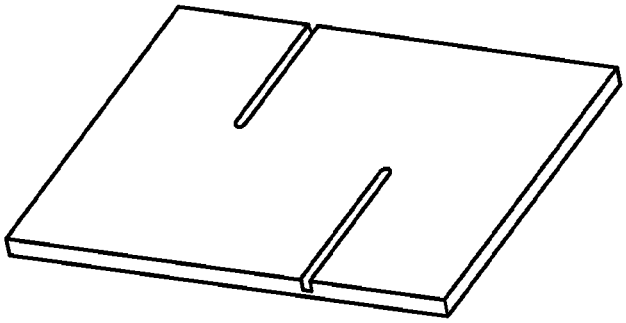
Figure 4F:
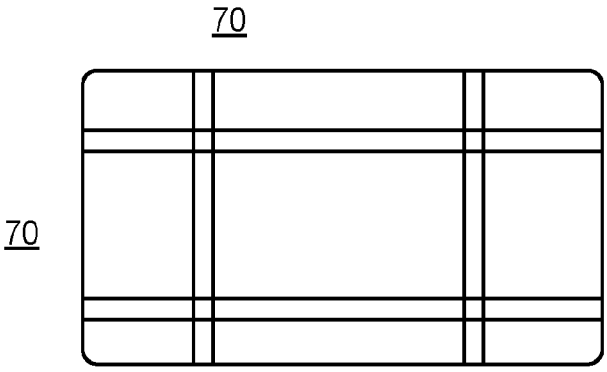

As shown in FIG. 4F, The underside of slab 10 has linear indentations 70 adapted to receive the edges of other slabs 20-50, as shown in different embodiments in FIGS. 4A, 4B and 4C. Thus, top slab 10, the thickness of which may in a specific embodiment be about 1 inch (2.54 cm) or higher, has a grooved bottom and snaps into place with some resistance. The remaining slabs 20, 30, 40 and 50 have a generally rectangular form and are roughly 1 inch (2.54 cm) thick.

The simplicity of this design is that each piece (slab) of the box slides into place like a number sign ("#") and offers as a result three different device heights depending on the orientation of the box, as shown in FIGS. 4A, 4B and 4C. As further shown in FIG. 4D, all box slabs lay in a stack one on top of the other in storage position, and as a result significantly minimize storage space requirements. To create height differential in separate embodiments, slabs 20 and 30 may be longer than slabs 40 and 50. As will be appreciated with reference to FIGS. 4A, 4B and 4C, the width of the slabs can determine the height of the plyo box in one example (FIG. 4A), while the length of the different pairs of slabs, that is 20 and 30 on one hand, and slabs 40 and 50 on the other hand determine the height of the box in the second and third operating exercise positions. In a specific example, the width of the support slabs can be 20 inches (50.8 cm), the length of slabs 40 and 50 could be 24 inches (60.96 cm), and the length of slabs 20, 30 can be 30 inches (76.2 cm). Other dimensions can be picked as desired.

When assembled for exercise, longer slabs 20 and 30 are positioned parallel to each other, likewise shorter slabs 40 and 50 are parallel to each other but positioned orthogonally to slabs 20 and 30. Each individual slab has a pair of slits, cutouts extending to about half the width of the slab. The resulting structure could be placed onto the ground in three different positions which determine the height of the resulting boxes. This, in a specific environment illustrated in FIG. 4A the support structure can lay on the edge of each of supporting slabs 20, 30, 40 and 50. In a specific environment illustrated in FIG. 4B the support structure can lay on the edge of shorter supporting slabs 40 and 50. In a specific environment illustrated in FIG. 4C the support structure can lay on the edge of longer supporting slabs 20 and 30. As a result, the same support structure comprising slabs 20, 30, 40 and 50 can be used with the top 10 in three different height configurations. It will be appreciated that in addition to the cutouts illustrated in FIG. 4F, the top slab can be equipped with additional means, such as bolts, to secure the top to the support frames.

Figure 4G:
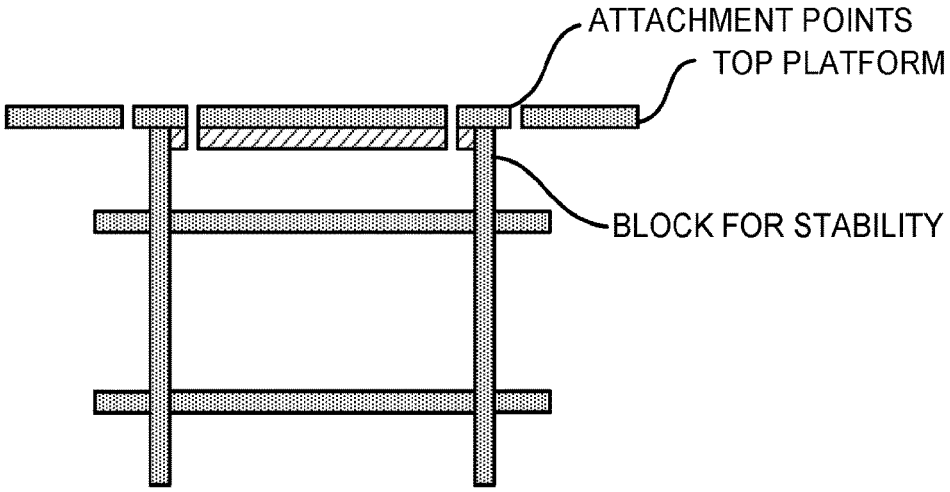
FIGS. 4G, 4H and 4I illustrate further detail in alternative examples of a plyometric exercise device using stackable support slabs.
Figure 4H:
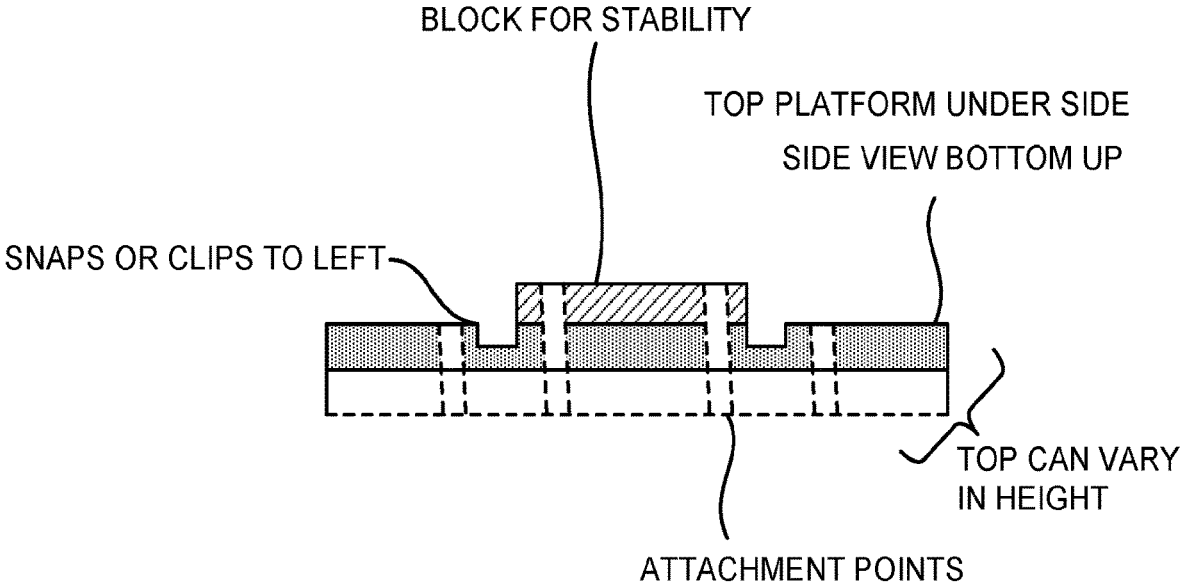
Figure 4I:
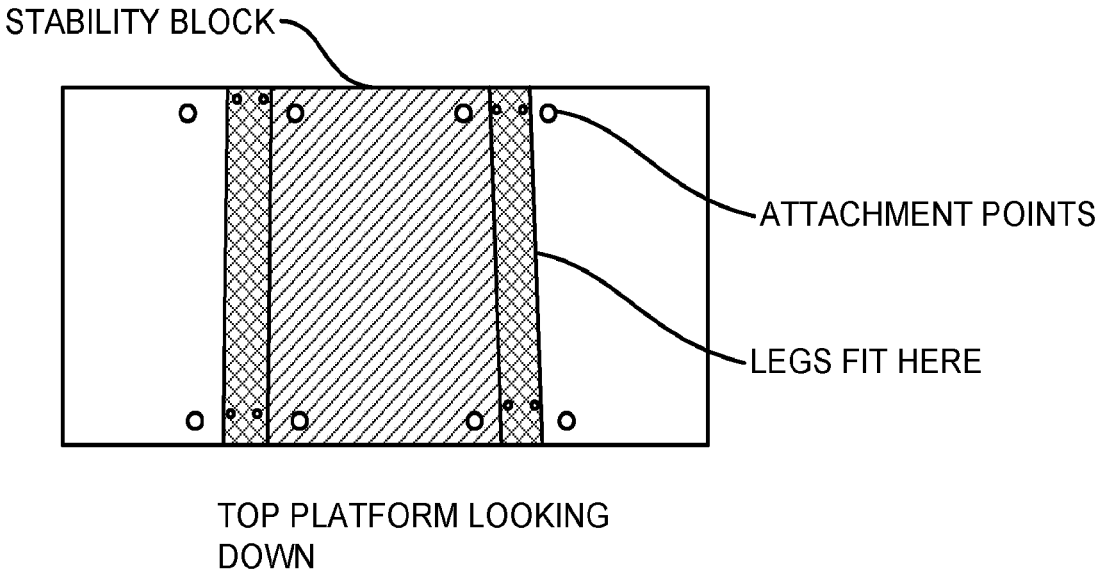

FIGS. 4G, 4H and 4I illustrate additional detail of a number sign collapsible plyo box in accordance with the current subject matter. For example, as shown in FIG. 4G, the top 110 can be reinforced with a separate block for stability.

Figure 5:
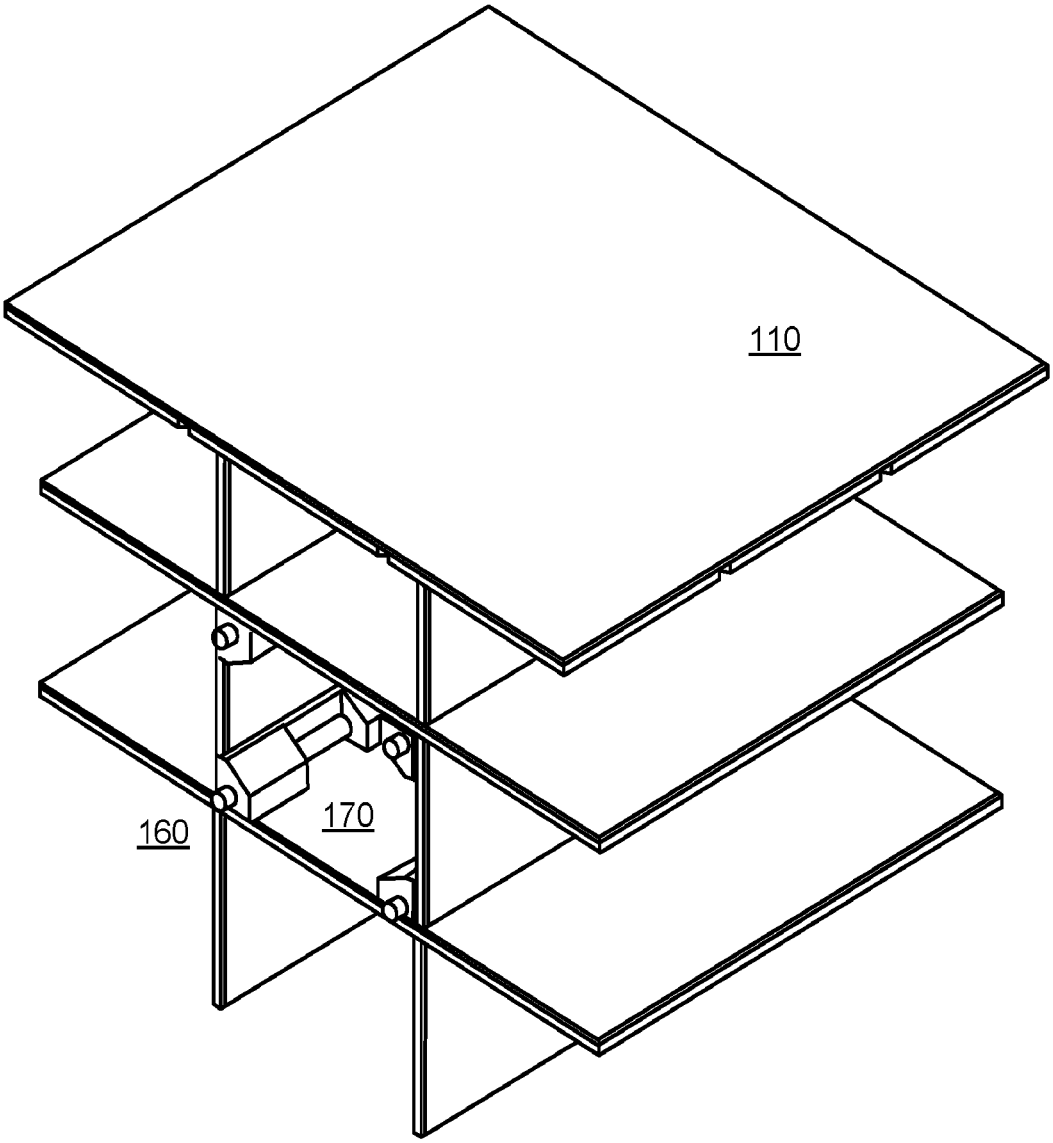
FIG. 5 illustrates a modified version of a plyometric exercise device in an example using stackable support slabs, in which the connection between interlocking slabs in the exercise position is reinforced.

A modified embodiment of the number sign design discussed above is illustrated in FIG. 5. That embodiment is substantially similar to the embodiment in FIG. 4A-4C, except for the use of reinforcing bolts 160, bars that each slide into a socket 170, formed at the cross point where the supporting slabs interlock in exercise position.

D. Support Legs Examples

Figure 6:
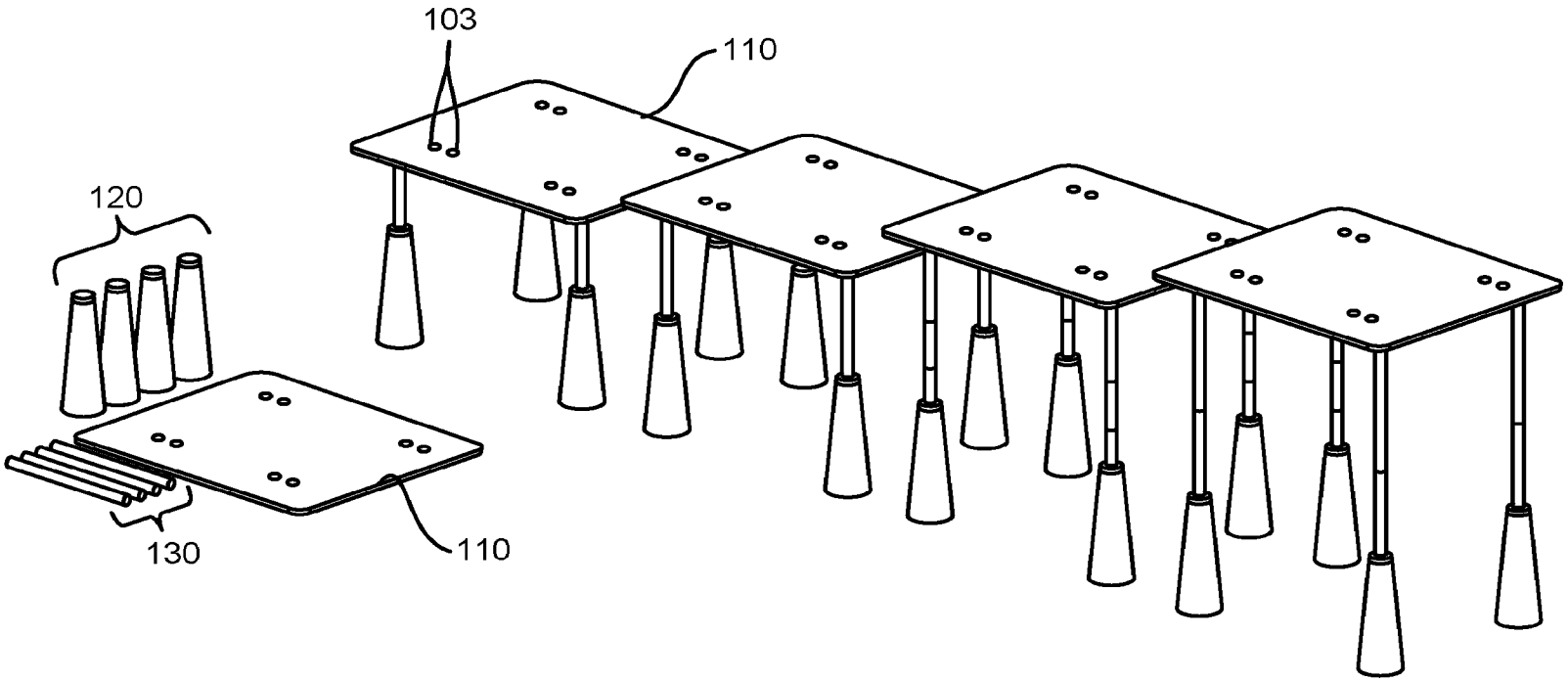
FIG. 6 illustrates another embodiment of a plyometric exercised device, in which the support frame is implemented using fixed length or extendible legs.

FIG. 6 illustrates another embodiment of the portable plyo box of the current subject matter, in which the support frame is implemented using fixed length or extendible legs.

As with other embodiments discussed herein, this exercise device has a top platform 110, a base designated 120, and support frame generally designated 130. The top 110 of the device is similar to other similarly labeled examples discussed above, which descriptions need not be repeated. As with other examples, top 110 could generally have a rectangular form as illustrated in FIG. 6, or could be circular or oval as desired. In an embodiment, the top 110 has holes on the jump platform to add resistance bands and other equipment. The end user can sit, stand, or lay on the box to preform exercises with the resistance bands or other equipment.

The base 120 of the device is formed by a set of four or more base legs which in the embodiment illustrated in FIG. 6 have a generally conical shape with a large base to provide a better grip onto the ground surface. In this embodiment, the support frame of the device is formed by a set of support rods or legs 130, which in different embodiments may have different lengths. The length of the support rods 130 determine the height of the exercise box, which can take standard or any other desired dimensions. In a specific example, support rods 130 can be integral solid rods. In alternate examples, the support rods can be hollow to reduce the overall weight of the device. Alternatively, support rods may be of expandable telescopic type. Alternatively, each support rod can be comprised of multiple rod sections that in exercise position fit into each other to achieve the desired length of the device. The support rods can be attached to the top at an angle between 80° to 90°.

It will be appreciated that the support legs 130 can be reinforced in exercise position for extra stability of the device. Two general approaches can be used to this end. First, as a person of skill in the art will appreciate, the legs can be secured to the top using a support frame (which can be made of metal) around the top that holds the legs in position. An additional support frame can also be used near the ground level to stabilize the legs' positions relative to each other and hence the entire structure.

E. Alternate Embodiments, Folding and all-Solid Side Panels

In the embodiments discussed above, the top 110 of each exercise box was described as strong and rigid platform capable of taking repeated powerful impact. In alternative embodiments, a single dense foam upper layer can be used at the jump surface. Optionally, beneath the upper layer a body formed from lower density foam can be provided, having greater compressibility than the upper layer. This arrangement provides a jump platform of suitable resilience that minimizes deformation and compression of the upper jump platform while also being soft enough to prevent impact injury. It will be appreciated that the use of foam may substantially increase the storage dimensions of the plyo box.

Figure 7A:
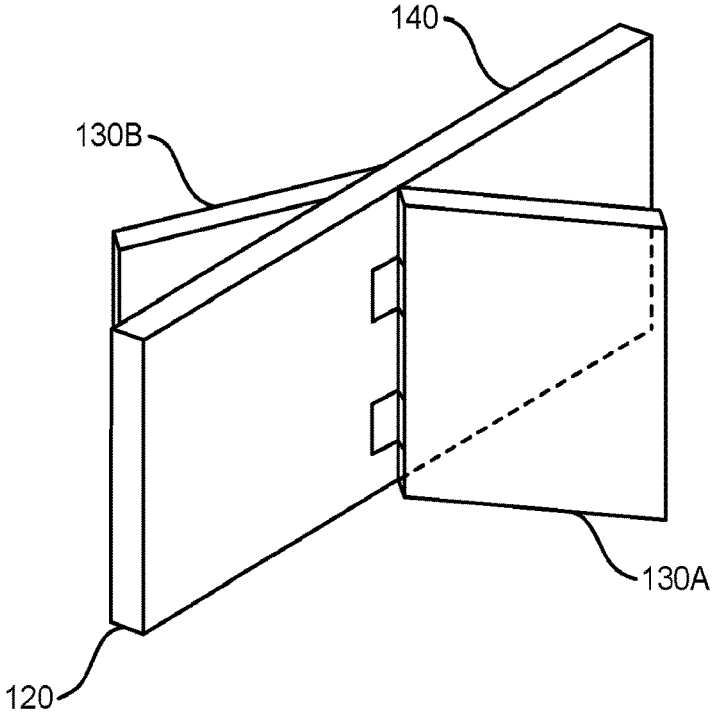
FIG. 7A is a perspective view of a support frame comprising folding components in a partially extended form in an alternative example.
Figure 7B:
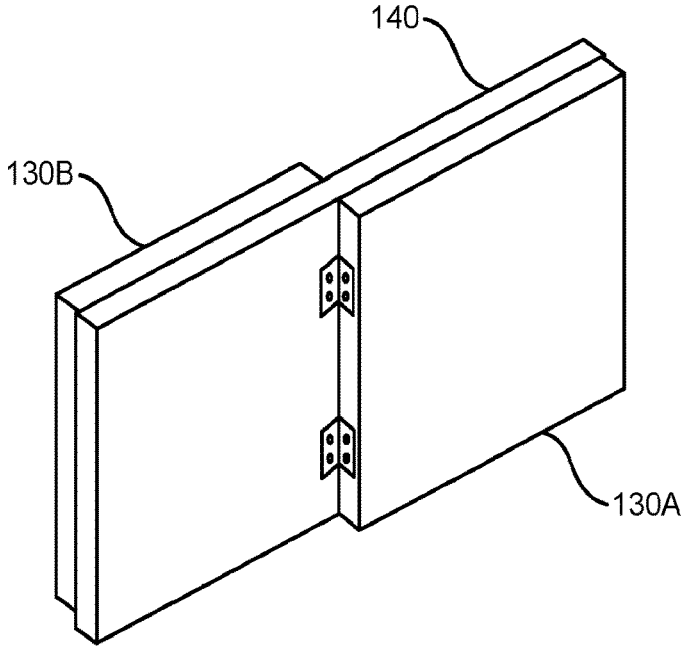
FIG. 7B shows the same folding support frame in a storage position.

In a particular example, similar to an embodiment discussed in the first example above, a support frame can be a combination of folding and solid components that in storage position take up minimum space, while in exercise position is fully extended and provides the requisite support for the top 110. One such example of a support frame is shown in FIGS. 7A and 7B. FIG. 7A is a perspective view of a support frame comprising folding components 130A and 130B in a partially extended form, and solid component 140. FIG. 7B shows the same components in a storage position in which they are folded onto each other.

Numerous other variations of a folding support frame can be provided in alternate examples. For example, similar to the illustrations in FIGS. 1A-1R, FIGS. 2 and 3, structural support for the plyo box 100 can be provided primarily by a set of four folding legs that in exercise position can extend from indentations in the four corners of a rectangular top to corresponding indentations in the four corners of the base. It will be appreciated that in the case of a circular top the legs can be positioned at perpendicular and diagonally opposite ends, and fit into corresponding top and base indentations. In the storage position, the legs can be removed and laid in parallel on the undersurface of the top using clips. In a specific example, the folding legs implementation can be supplemented with side panels, as discussed above, for enhanced structural integrity. It will be appreciated, however, that because the load-bearing function of the support will be carried by the legs, the support panels can be made lighter to reduce the overall weight of the device.

FIGS. 10A-10N illustrate an alternative embodiment of a collapsible plyo box in which solid side panels attached to the top and the base collapse in the storage position onto each other in a given order, and the entire support frame is at least partially enclosed between the flat top and the base forming a self-contained plyo box. The term "self-contained" is used herein to designate a structure in which individual components are attached to each other in a manner allowing them to be stored or moved around collectively as a unit. All this figures are conceptual illustrations, drawings that show and explain arrangement and relations of different parts, and are not drawn to scale.

Specifically, FIG. 10A is a diagrammatic representation of the plyo box 100 with collapsible solid side panels. For ease of reference in the remaining figures, the flat top 110 is also designated as "T", the base surface 120 is designated "B". Two opposite solid side panels on the left and right of the drawing are designated respectively S1 and S2, while opposite sides, front and back solid side panels, are designated S3 and S4.

Figure 10B:
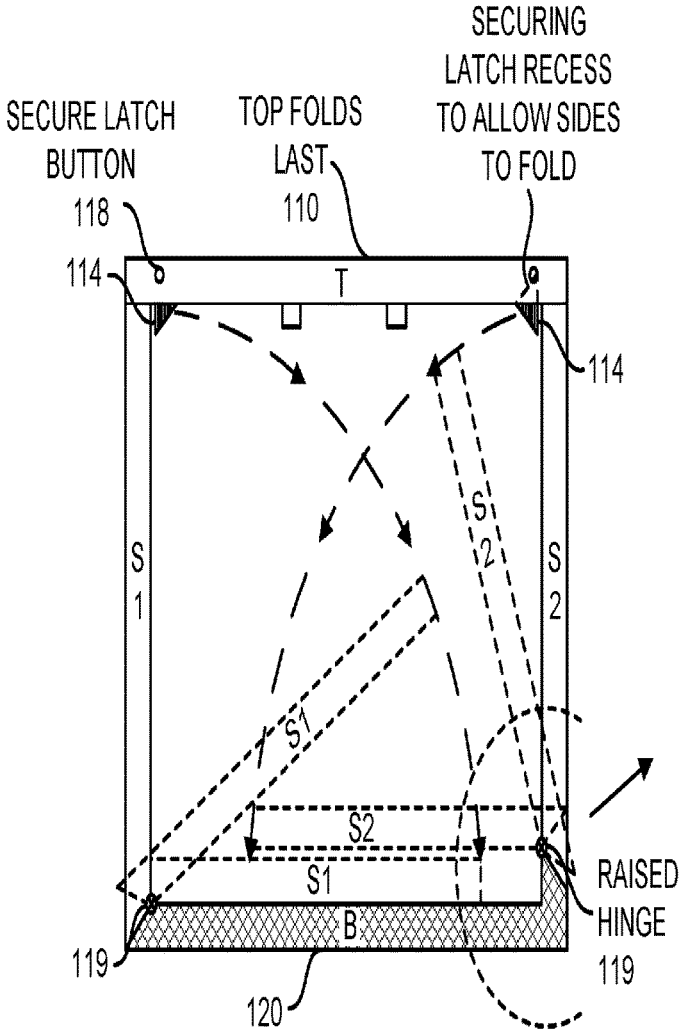
FIG. 10B is a side view illustrating the process of collapsing opposite side panels onto the base.
Figure 10C:
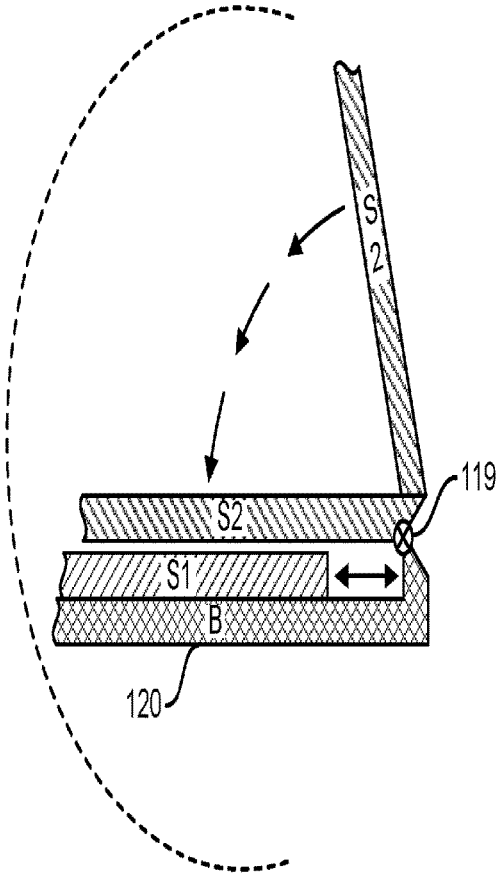
FIG. 10C is an exploded view of one side panel collapsing on top of another side panel in storage position.
Figures 10D, 10E, 10F:
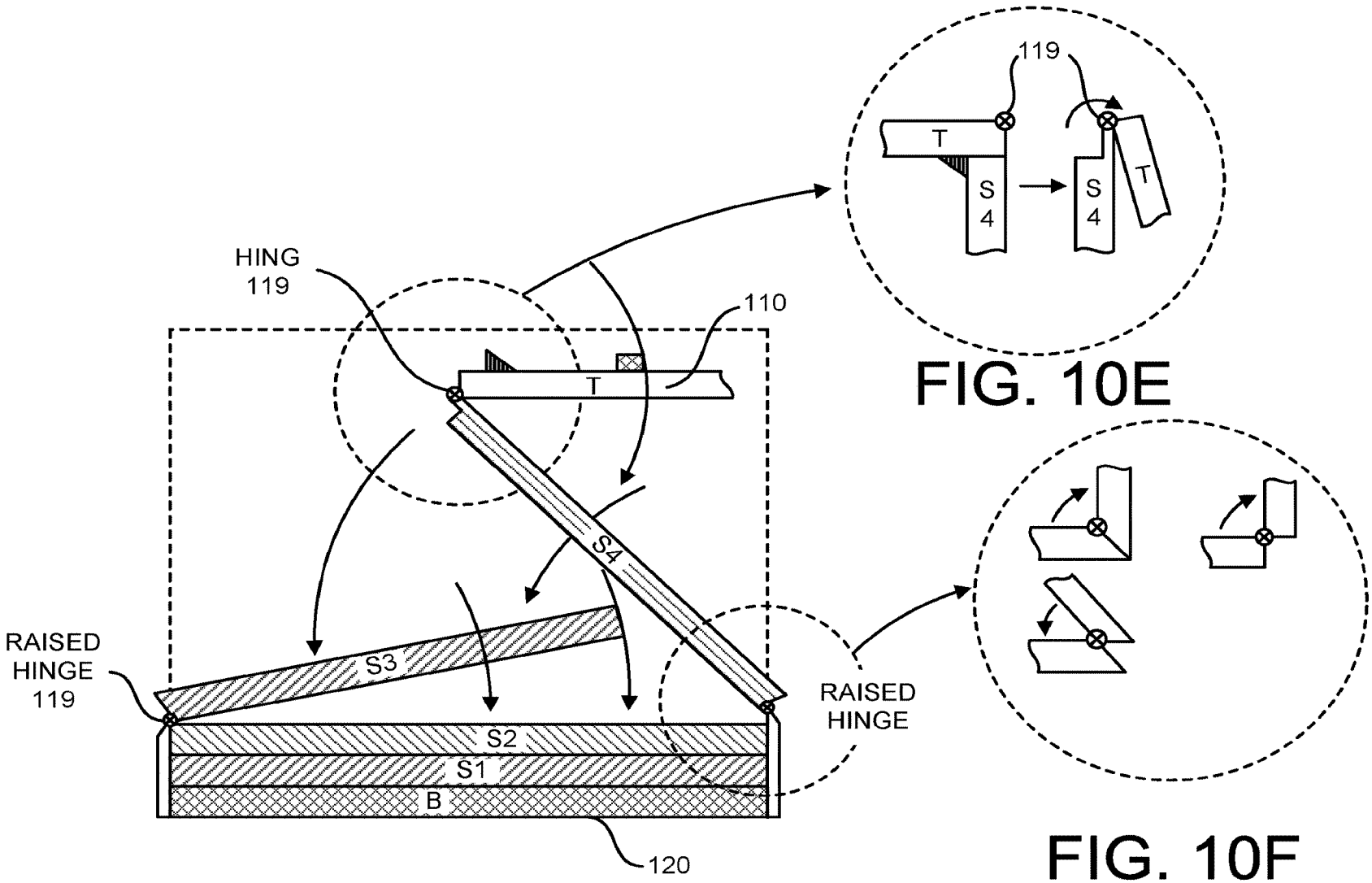
FIG. 10D is a 90° shifted side view illustrating the process of collapsing additional side panels along with the top "T" onto the base and the panels shown in FIG. 10C.
FIGS. 10E and 10F are exploded views illustrating in more detail hinge connections.

With the above labeling conventions, FIG. 10B illustrates a side view of the plyo box 100 in assembled exercise position (side panels S1 and S2 shown in solid lines), as well as interim and storage position(s) shown in dashed lines. As shown, in the exercise position side panels S1 and S2 may be substantially perpendicular to the base 120 (also designated "B") and support the top 110 of the box (also designated "T"), though it will be appreciated that other angles of inclination can also be used. Side panels S1 and S2 are attached to the base 120 by means of hinges 119, which open to about 90°. As shown in the figure in solid lines, and is also illustrated in FIG. 10F, the edges of the slabs and of the base 120 may be inclined at an angle (such as a 45° angle) for additional stability and support of the plyo box in the exercise position. At the top, side panels S1 and S2 support flat top 110 and are held in position using latches 114.

Figure 11B:
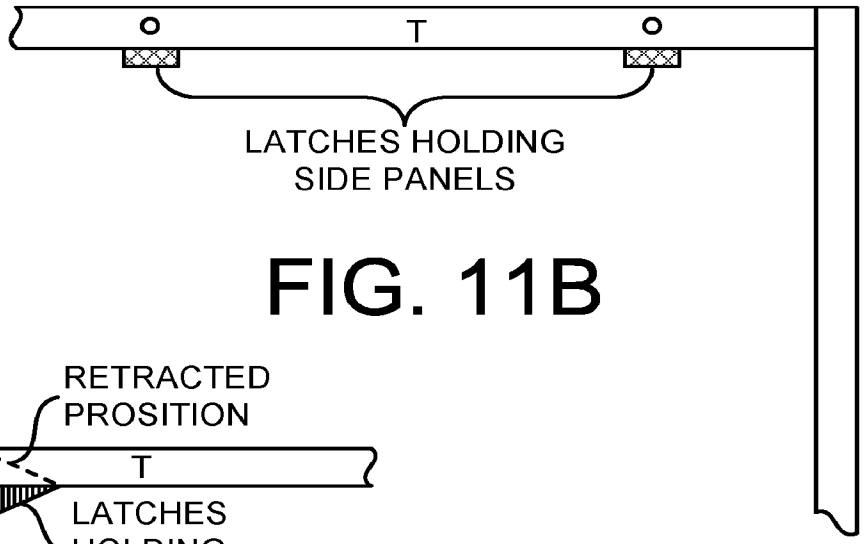
FIGS. 11A, 11B and 11C illustrate retractable latch mechanisms for permitting the side panels to support the top of the plyo box in exercise position and to collapse the side panels onto the base in retracted position.
Figure 11C:
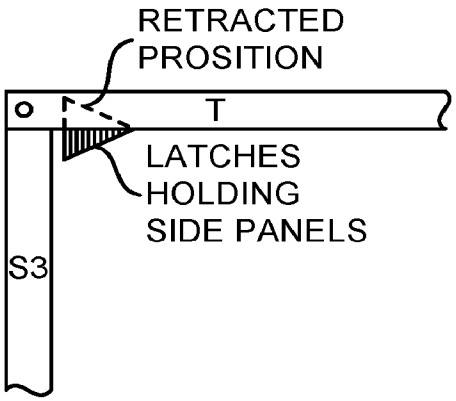
Figure 11A:
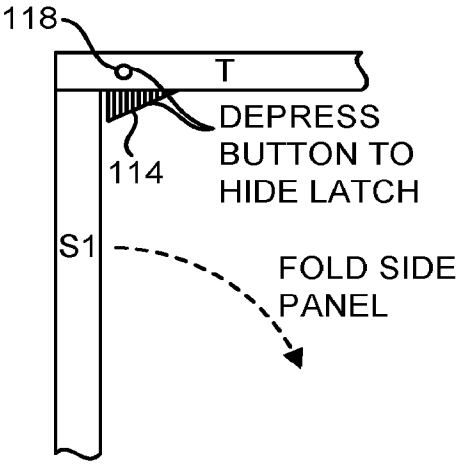

Latches 114 used in particular examples can be any devices in which mating mechanical parts engage to detachably fasten two surfaces to each other. One example that is illustrated in FIG. 10B and also in more detail in FIGS. 11A, 11B and 11C is a pivoted bar that falls into a notch when in storage position and is actuated, in this case hidden, by depressing a secure latch button 118 illustrated in FIG. 11A. That is, in one position latch 114 sticks out and prevents the side panel from moving laterally and specifically from collapsing under the flat top, and in the other position, illustrated in dashed lines in FIG. 11C is retracted into a notch in the top 110, and allows the side panel to pivot around hinge 119 and lay on top of the base 120. Thus, for example, in FIG. 10B side panel S1 is substantially vertical in exercise position. When the secure latch button 118 is depressed, latch 114 retracts into the top 110, and allows side panel S1 to rotate clockwise around the hinge 119 into the storage position of the box in which it lays flat on top of the base 120.

On the opposite side of the base, side panel S2 is attached in exercise position to the top 110 and to base 120 in substantially similar manner, and likewise folds in storage position by rotating counterclockwise about a hinge until it lays on top of panel S1. Of note is that to account for the thickness of side panel S1, a raised hinge 119 can be used. FIG. 10C is an exploded view of this part of the box which provides additional detail on how the base 120, and side panels S1 and S2 stack on top of each other in storage position. FIG. 10C also illustrates that the height of the side panels may, but need not correspond to the dimensions of the base, and in particular may be shorter, leaving some space from the top of the side panel to the edge of the base. The edges of the base and side panel S2 may also be cut at a 45° angle for added stability, or be cut straight, as also shown in FIG. 10F. Other arrangements in which the side panels that support the flat top and are allowed to rotate about a hinge in the base and be stacked in the storage position will be apparent to a person of skill in the art. It will also be appreciated that all dimensions of the plyo box, materials and features used can be selected according to the principles discussed above in Section A of the Detailed Description.

FIG. 10D is a 90° shifted side view of the pyo box, illustrating the process of collapsing the remaining solid side panels along with the top "T" onto the base and panels S1 and S2. Starting at the bottom, side panels S3 and S4 are connected to the base 120 in a manner similar to the one described in FIG. 10B. It will be appreciated that to account for the thickness of the side panels S1 and S2, one can use raised hinges 119. It will also be appreciated that to allow a top surface parallel to the base in the exercise position, in this embodiment the height of the side panels may differ.

The main difference between the attachment of side panels shown in FIG. 10B and FIG. 10D is that solid panel S4 in this example is also attached via hinge 119 to the top of the box 110. As illustrated, this arrangement allows collapsing the entire box 100 onto itself, as side panel S3 rotates 90° clockwise to rest on the flat surface of panel S2, and then side panel S4 rotates 90° counterclockwise to lay on top of panel S3. Likewise, the top 100 rotates clockwise around hinge 119 (in this case at a substantially 270° angle) to lay flat on top of side panel S4. That is, in storage position all six sides of the plyo box 100 can be stacked on top of each other, reducing the overall storage dimensions of the box, while at the same time holding the box together as a unit.

The rotation of the top hinge is illustrated in the exploded view in FIG. 10E. On the left side of FIG. 10E, the top 110 is shown resting on the edge of side panel S4 at about 90° angle in the exercise position of the box. On the right side of FIG. 10E the top is rotated clockwise to about 270° which enables the top 110 to be stacked flat on side panel S4. As shown in the figure, a raised hinge 119 can be used to enable such a rotation.

Figure 10G:
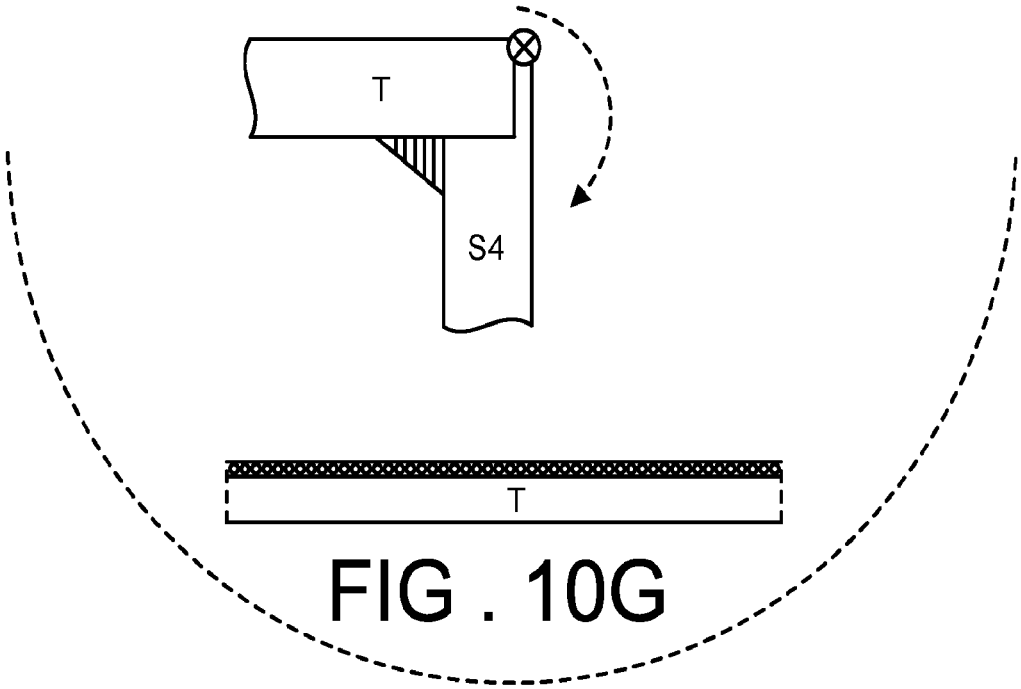
Figure 10H:
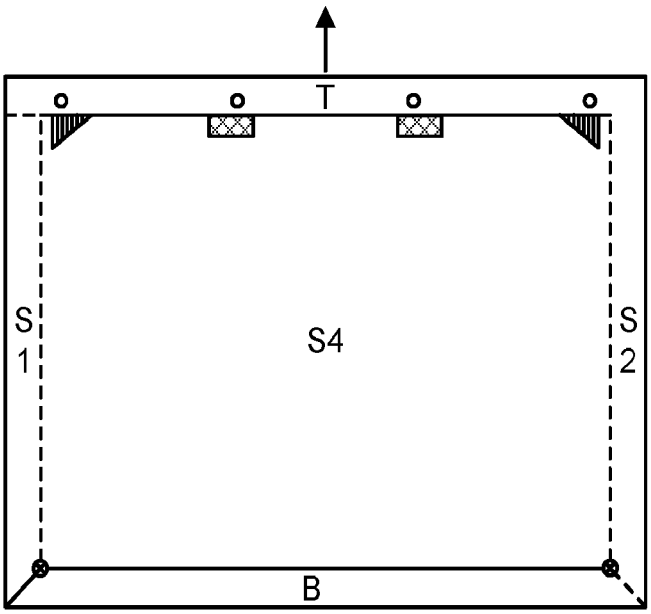
Figure 10I:
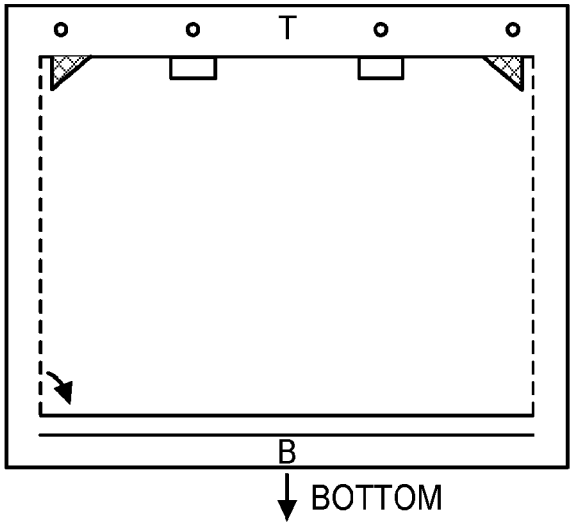
FIGS. 10I and 10J show a 90° shifted side view on the other side of the box.

FIG. 10G and FIG. 10H are side view illustrations with certain elements shown in greater detail. In particular, FIG. 10H shows a side view of a cross-section of the box in the exercise position, (not to scale) in which side panels S1 and S2 are locked in position via hinges at the base, and latches at the top. In FIG. 10G one can notice the hinge connecting the top "T" to side panel S4. As shown, the hinge used in this and other instances of hinge connections in this embodiment may be of the "piano" type, that is, long continuous hinge named for the hinge on a piano's lid, in which a long rod runs through the knuckles of this hinge's two long leaves, holding it together. It will be appreciated that others types of hinges can be used, as appropriate. Also shown at the top of FIG. 10G is a 90° angle shifted view that shows the connection between side panel S4 and the top "T" in exercise position. FIG. 10I is a diagram substantially similar to FIG. 10H, while the cutout in FIG. 10J is similar to FIG. 10G but illustrates the base connection with the side panel S3.

Figure 10K:
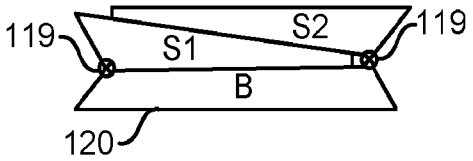
FIG. 10K illustrates an embodiment in which the side panels are thicker at the base and slope toward the top, which allows a different stacking of the side panels in storage position.
Figure 10J:
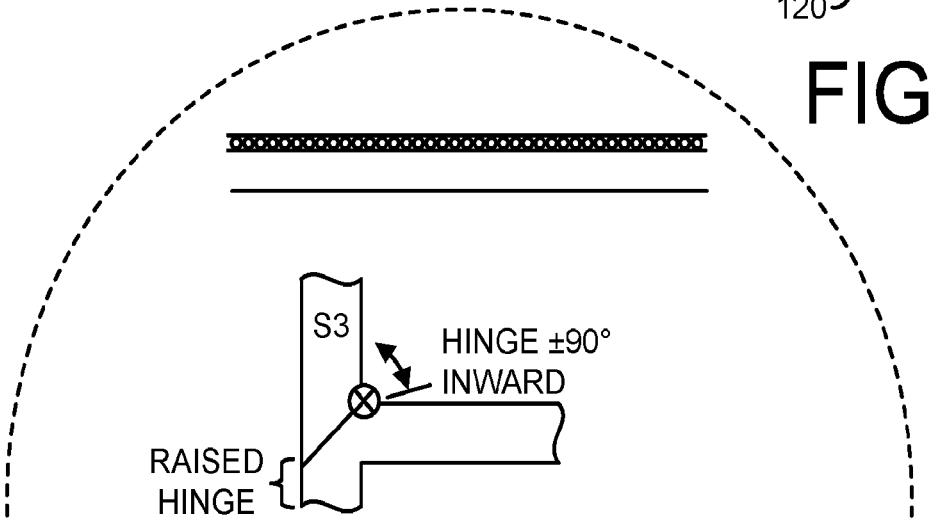

FIG. 10K illustrates an alternate embodiment in which the side panels are thicker at the base and slope toward the top, which allows a different stacking of the side panels in storage position. Only side panels S1 and S2 are shown, connected by hinges 119 to base 120. As illustrated, when panel S1 is folded on top of the base 120 and panel S2 is folded on top of panel S1, the top surface of panel S2 is substantially parallel to the surface of the base, even though the individual side panels are sloping. The advantage of this embodiment is that it reduces or potentially even eliminates the need for raising certain hinges and in particular, dependent on the height of the side panels, may eliminate the need for a raised hinge 119 attaching panel S2 to the base. The same arrangement can be used at the connection between side panels S3 and S4 to the base (not illustrated). It will be appreciated that the use of raised hinges may complicate to some extent the design of the base, but these complications are offset by the fact that the embodiment results in a plyo box that can be used in both exercise and storage position as an integral (also termed "self-contained") unit with all solid side panels. In particular, such a design combines the convenience of dealing with one unit with the stability of a structure having all solid panels. In addition, raised hinges can be implemented via 3D printing and other techniques that can effectively obviate any manufacturing concerns.

FIGS. 10L, 10M and 10N illustrate the use of various attachments that provide additional design flexibility, especially in the storage position. In particular, FIG. 10L illustrates stacking of side panels and the flat top in the storage position. This illustration is substantially similar to FIG. 10D. FIG. 10M illustrates in exploded view the connection of the flat top 110 with side panel S4, and in particular some extra features that can be used in the top. Specifically, as illustrated in this example, one can have a pull out handle 114, which in the exercise position is inserted into the edge of the top 110, and be pulled out in the storage position once the top is rotated about its connection to side panel S4. Another feature of this example is the use of an extendible strap 116, which in the exercise position is inserted into a recess of the underside of top 110. In storage position, once the base, the side panels and the top are all stacked on top of each other, strap 116 is accessible since the underside is now positioned on the top. Then, as illustrated in FIG. 10N, the strap can be extended to hold together the entire collapsed box for ease of storage and transportation. FIG. 10N also illustrates an example in which a fold out wheel 112 is stored at the base, and in collapsed position can be pulled out to help move the box more easily. While both a handle stored in the top, and a wheel stored in the base are illustrated in this example, it will be appreciated that different combinations may be used dependent on the size of the box, the strength of the materials and other factors that determine if extra features are desirable or feasible to include.

As already noted, FIGS. 11A, 11B and 11C illustrate retractable latch mechanisms for permitting the side panels to support the top of the plyo box in exercise position and to collapse the side panels onto the base in retracted position. These drawings were considered above, which discussion need not be repeated.

Figure 12:
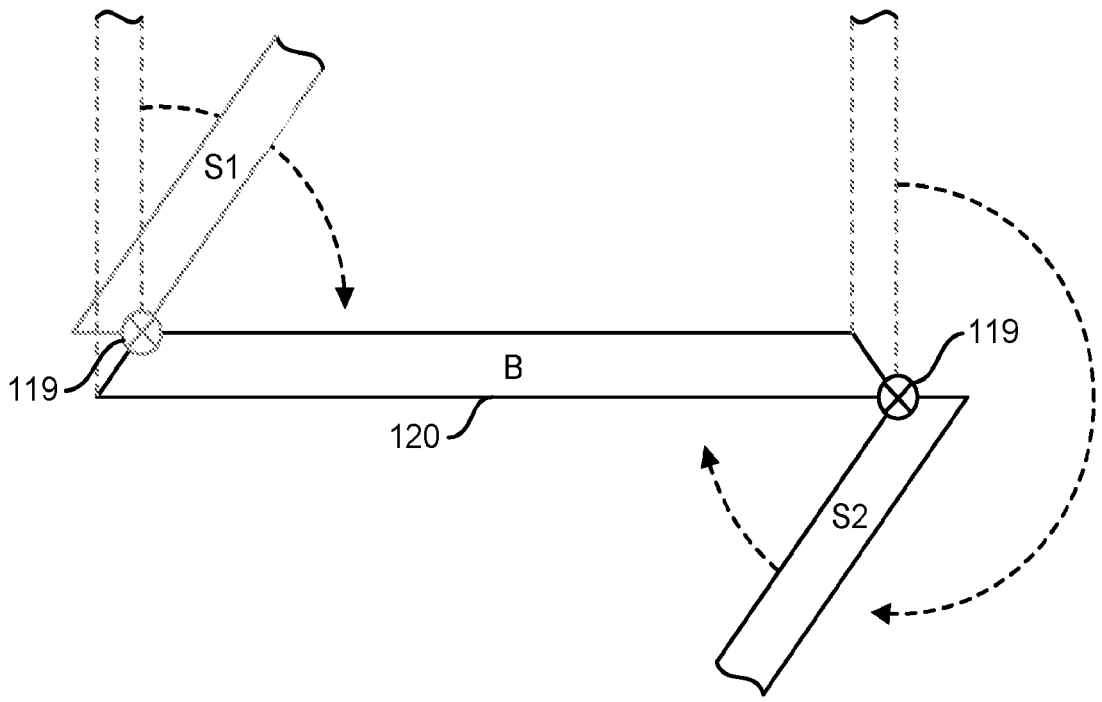
FIG. 12 illustrates another example, in which both opposite side panels pivot in the same direction to collapse on the upper and lower surfaces of the base (or the top), respectively.

FIG. 12 illustrates another example of a plyo box having all solid side panels, in which both opposite side panels pivot in the same direction to collapse on the upper and lower surfaces of the base (or the top), respectively. As shown in the figure, when collapsed for storage, side panel S1 can rotate clockwise around the hinge 119 to lay flat on the upper surface of the base. When collapsed for storage, side panel S2 also rotates clockwise but at about 270° to lay flat on the undersurface of the base 120. While in this embodiment care must be taken to position the hinges 119 as shown, it has the advantage of placing no limitation on the height of the side panels, and hence provides the flexibility of constructing plyo boxes of different heights. Substantially the same arrangement (not shown) can be used to collapse in storage position opposite side panels S3 and S4 as connected to the top 110. Other features of the embodiment will become apparent upon examination of FIGS. 10A-10N, and need not be repeated. In this embodiment, the group of base plus side panels S1 and S2 can be attached using an extendible strap or other like means to hold all components of the plyo box together. Other extensions discussed above, such as the use of handle or wheels will be apparent and need not be repeated.

Figure 9:
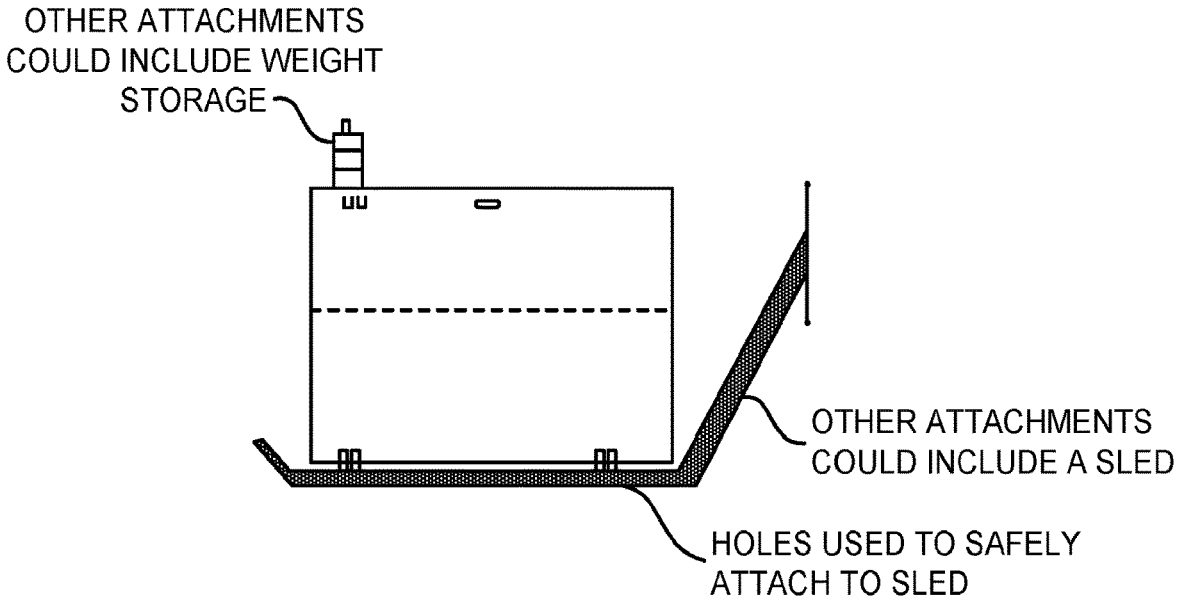
FIG. 9 illustrates advanced optional feature of a plyo box convertible to a weight sled.

Finally, it is expected that the support side panels, as well as the top and base surfaces can use the features discussed above in connection with the description in Section B of the folding support examples, including for example: recesses 107 (see FIG. 1A) to keep a stack of plyo boxes together for storage or use in a stacked set for height variation and flexibility; holes 103 on the top 110 for adding resistance bands and other equipment used in conjunction with the plyo box (see FIG. 8), or other options considered above and illustrated, for example, in FIGS. 8 and 9. See also the description of optional enhancements in Section F below. It will also be appreciated that side panels, base and top can be used for design enhancement to contain logos, symbols or other design features that increase the commercial value of the box.

F. Optional Enhancements

Conceptually, plyometric boxes can be thought of as raised platforms one can jump from or to, and the primary focus of this disclosure is on reducing the space taken up by the device in storage or transportation position, and/or making it easier to transport the device from one exercise location to another. In accordance with different aspects of the disclosure, several optional features can be added to increase the utility of the device and broaden the scope of exercises that can be performed with the aid of the device. One such example of exercise options is the use of two or more holes 103 on the top 110 for adding resistance bands and other equipment used in conjunction with the plyo box. This option was considered above and is illustrated in FIG. 8.

Another option is the use of holes to attach to the device other items, such as a ropes or a handle to convert the plyo box into a weight sled. That option is illustrated in FIG. 9. A weight sled is a device used for pushing or dragging weights and hence is often loaded up with extra weight. These devices work well and are a very effective training aid for home use, assuming an open space to move, such as an accessible street or a driveway. As in the case of plyo boxes, the downside of weight sleds again is storage space. As shown in FIG. 9, the collapsible plyo box of this disclosure can be converted to a weight sled, a completely different exercise device, by attaching a sled and providing additional storage space for weights, or other exercise equipment, which in turn can be used as an exercise while pushing or dragging the plyo box.

It is expected that the plyo box/sled combo would most likely be used with the box in a collapsed position with or without added weight. The idea is that the user could nest the box or boxes in their closed position on the sled as seen in the figure when the plyo box is not in use, effectively creating two very different exercise mechanisms using substantially the same device construction. Thus, directly from the storage position of the plyo box the user could add or remove weight and pull the sled out of the garage to use in a workout. Nested on that sled could be the box as well as extra weight. It is expected that adding the ability to store or load weight will improve the utility of the combination device.

Another optional improvement is the adaptation of the plyo box as a glute ham developer (GHD). Athletes and gym users can be provided with a more affordable, space-efficient alternative. The benefit of the design discussed herein is that there is no need for a rack to build a GHD off this box. One side could be for holding the feet, the other set of holes could have a cushion to sit on. Other variations can be designed to customize the plyo boxes of this disclosure for a variety of other uses and exercises.

G. Miscellaneous Observations

One of skill in the art will recognize that the described examples are not limited to any particular equipment size, shape or construction. Further, one of skill in the art will recognize that the components of a portable plyometric device in accordance with the current subject matter are not limited to any type of material. As a non-limiting example, the plyometric exercise devices are formed primarily from one or more of wood, metal, composite plastic, high density foam, rubber or similar materials. One skilled in the art will recognize that other dimensions, types and thicknesses of materials can be utilized when taking into consideration. It will also be appreciated that different surfaces (or sides) of the plyometric device(s) can be made of different materials dependent on the requirements placed on the specific surfaces.

It will be appreciated by those skilled in the art that changes could be made to the embodiments described above without departing from the broad inventive concept thereof. It is understood, therefore, that the subject matter disclosed herein is not limited to the particular embodiments disclosed, and is intended to cover modifications within the spirit and scope of the present subject matter.

What is claimed is:

1. A plyometric exercise device, comprising:

a flat top;

a base; and a folding support frame;

wherein the plyometric exercise device is configured as a box in an exercise position in which the folding support frame is attached to and raises the flat top above the base to a predetermined distance corresponding to an exercise height of the plyometric exercise device; and a storage position in which the folding support frame is folded and is at least partially enclosed within a recess of the flat top, reducing a distance between the flat top and the base to a storage height of the plyometric exercise device;

wherein the folding support frame comprises (a) one or more folding side panels, each comprising two leaves connected by a hinge enabling rotation about a horizontal axis thereof such that in the storage position the two leaves are folded on each other, and in the exercise position the two leaves are rotated about the hinge to provide a maximum side panel extension and to support the exercise height of the plyometric exercise device; and (b) one or more support studs, which in the exercise position of the plyometric exercise device extend from the flat top to the base of the plyometric exercise device to support the one or more folding side panels in an extended position, and in the storage position of the plyometric exercise device fit at least partially within a storage space in one or both of the flat top and the base.

2. The plyometric exercise device of claim 1, wherein the flat top has a rectangular shape and rounded corners.

3. The plyometric exercise device of claim 1, further comprising one or more rigid one-piece side panels that in the exercise position extend between the flat top and the base and provide support for the flat top, said one or more rigid one-piece side panels fitting at least partially within the recess of the flat top in the storage position.

4. The plyometric exercise device of claim 1, wherein the flat top has a layer of material providing increased friction.

5. The plyometric exercise device of claim 1, wherein the base further comprises a plurality of adjustable feet that may be used when the plyometric exercise device is placed on a ground surface to adjust the plyometric exercise device in position above the ground surface.

6. The plyometric exercise device of claim 5, wherein the flat top further comprises recesses corresponding to positions of the plurality of adjustable feet on the base, to enable stacking of multiple plyometric exercise devices on top of each other in the storage position or the exercise position.

7. The plyometric exercise device of claim 1, wherein the storage height of the plyometric exercise device is at least three times shorter than the exercise height of the plyometric exercise device.

8. The plyometric exercise device of claim 1, wherein the exercise height of the plyometric exercise device is one of 12 inches, 20 inches, 24 inches or 30 inches, and further wherein in the exercise position, the one or more support studs attach to at least one of the flat top or the base at an indent or a pass-through hole.

9. The plyometric exercise device of claim 1, further comprising one or more I-beam support studs to support different surfaces of the plyometric exercise device in the exercise position.

10. The plyometric exercise device of claim 1, further comprising at least two holes each having approximately a 1 inch diameter in the flat top and a notch on an underside surface of the flat top for attaching resistance bands.

11. The plyometric exercise device of claim 1 wherein the base comprises one or more indents for housing wheels to transport the plyometric exercise device.

12. The plyometric exercise device of claim 11, wherein the wheels are one or more folding wheels that in the exercise position of the plyometric exercise device respectively fit within the one or more indents, and in the storage position are folded out to enable rolling the plyometric exercise device on the one or more wheels.

13. The plyometric exercise device of claim 11, further comprising a handle attached to the flat top or to the base for carrying the plyometric exercise device in the storage position.

14. The plyometric exercise device of claim 1, further comprising a sled, removably attached to the base of the plyometric exercise device, and a handle for pushing or pulling the plyometric exercise device on the sled.

15. The plyometric exercise device of claim 14, wherein the storage space is configured for placing additional weights.

16. Two or more of the plyometric exercise devices of claim 1 stacked on top of each other, each of the two or more plyometric exercise devices being either in the storage position or in the exercise position.

* * * * *